US012736261B2

(12) United States Patent
Kim et al.

(10) Patent No.: US 12,736,261 B2
(45) Date of Patent: Sep. 15, 2026

(54) AIR CONDITIONER

(71) Applicant: LG ELECTRONICS INC., Seoul (KR)

(72) Inventors: Daehyoung Kim, Seoul (KR); Yongcheol Sa, Seoul (KR); Jiyoung Jang, Seoul (KR); Chiwoo Song, Seoul (KR); Jisung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 219 days.

(21) Appl. No.: 18/380,291

(22) Filed: Oct. 16, 2023

(65) Prior Publication Data

US 2024/0133605 A1 Apr. 25, 2024
US 2024/0230193 A9 Jul. 11, 2024

(30) Foreign Application Priority Data

Oct. 25, 2022 (KR) ..... 10-2022-0138146

(51) Int. Cl.
*F25B 49/02* (2006.01)
*F25B 41/34* (2021.01)

(52) U.S. Cl.
CPC ..... *F25B 49/022* (2013.01); *F25B 41/34* (2021.01); *F25B 2313/0233* (2013.01); *F25B 2600/2513* (2013.01)

(58) Field of Classification Search
CPC ..... F25B 49/022; F25B 41/34; F25B 2313/0233; F25B 2600/2513
See application file for complete search history.

(56) References Cited

U.S. PATENT DOCUMENTS 7,954,333 B2 6/2011 Yoshimi
2014/0216082 A1 8/2014 Morimoto et al.
2015/0135753 A1* 5/2015 Abe ..... F25B 49/005 62/228.1
2018/0252443 A1 9/2018 Naito et al.

FOREIGN PATENT DOCUMENTS

EP 1 586 836 10/2005
JP 4179783 B2 * 11/2008
KR 10-2021-0131237 11/2021
KR 10-2022-0019933 2/2022

OTHER PUBLICATIONS

FOR3, Air Conditioner, 2008, Full Document (Year: 2008).*
European Search Report issued in Application No. 23204452.9 dated Mar. 13, 2024.
Korean Office Action issued in Application No. 10-2022-0138146 dated Dec. 19, 2024.

* cited by examiner

*Primary Examiner* — Nael N Babaa
(74) *Attorney, Agent, or Firm* — KED & ASSOCIATES

(57) ABSTRACT

An air conditioner may include a controller; a compressor that compresses a refrigerant; an outdoor heat exchanger through which the refrigerant discharged from the compressor flows; a plurality of expansion valves that expands the refrigerant passed through the outdoor heat exchanger; a plurality of indoor heat exchangers through which the refrigerant passed through the plurality of expansion valves flows; a plurality of connection pipes that connects the plurality of indoor heat exchangers and the compressor; and a plurality of variable valves installed in the plurality of connection pipes. An opening degree of each of the plurality of variable valves may be adjustable via the controller.

18 Claims, 14 Drawing Sheets

FIG. 10

| Error \ Error slope | | | | | | | | | | | | |
|---|---|---|---|---|---|---|---|---|---|---|---|---|
| | −8 | −8 | −8 | −8 | −8 | −8 | −8 | −5 | −3 | −3 | −3 | −2 | −1 |
| | −8 | −8 | −8 | −6 | −5 | −5 | −5 | −3 | −2 | −2 | −2 | −1 | −1 |
| | −8 | −8 | −8 | −5 | −3 | −3 | −3 | −2 | −1 | −1 | −1 | −1 | 0 |
| (+) | −5 | −5 | −5 | −3 | −2 | −2 | −2 | −1 | −1 | −1 | −1 | 0 | 1 |
| | −3 | −3 | −3 | −2 | −1 | −1 | −1 | −1 | 0 | 0 | 0 | 1 | 1 |
| | −3 | −2 | −2 | −1 | −1 | −1 | −1 | 0 | 0 | 0 | 1 | 1 | 2 |
| 0 | −3 | −2 | −1 | −1 | 0 | 0 | 0 | 0 | 0 | 1 | 1 | 2 | 3 |
| | −2 | −1 | −1 | 0 | 0 | 0 | 1 | 1 | 1 | 1 | 2 | 2 | 3 |
| | −1 | −1 | 0 | 0 | 0 | 1 | 1 | 1 | 1 | 2 | 3 | 3 | 3 |
| | −1 | 0 | 1 | 1 | 1 | 1 | 2 | 2 | 2 | 3 | 5 | 5 | 5 |
| (−) | 0 | 1 | 1 | 1 | 1 | 2 | 3 | 3 | 3 | 5 | 8 | 8 | 8 |
| | 1 | 1 | 2 | 2 | 2 | 3 | 5 | 5 | 5 | 6 | 8 | 8 | 8 |
| | 1 | 2 | 3 | 3 | 3 | 5 | 8 | 8 | 8 | 8 | 8 | 8 | 8 |
| | | | (−) | | | | 0 | | | | (+) | | |

AIR CONDITIONER

CROSS-REFERENCE TO RELATED APPLICATION(S)

This application claims priority from Korean Patent Application No. 10-2022-0138146, filed in Korea on Oct. 25, 2022, in the Korean Intellectual Property Office, the disclosure of which is incorporated herein by reference in its entirety.

BACKGROUND

1. Field

An air conditioner is disclosed herein.

2. Background

In general, an air conditioner refers to a device that heats or cools a room through processes of compression, condensation, expansion, and evaporation of a refrigerant. When an air conditioner includes a plurality of indoor heat exchangers, respective indoor spaces may be simultaneously heated and cooled. In addition, it is possible to switch an operation mode of the air conditioner. That is, a heating operation may be switched to a cooling operation, or the cooling operation may be switched to the heating operation.

However, in a conventional air conditioner, evaporation pressures of a plurality of indoor heat exchangers performing the cooling operation are identical to each other, such that the plurality of indoor heat exchangers cannot but have the same blowdown temperature. For this reason, there is a problem in that it is difficult to adjust the blowdown temperature for each indoor space to meet the needs of occupants.

BRIEF DESCRIPTION OF THE DRAWINGS

Embodiments will be described in detail with reference to the following drawings in which like reference numerals refer to like elements, and wherein:

FIG. 10 is a graph for explaining a method for adjusting the opening degree of a variable valve to adjust a temperature of refrigerant in an inlet side of the indoor heat exchanger to a target temperature;

DETAILED DESCRIPTION

Description will now be given according to exemplary embodiments disclosed herein, with reference to the accompanying drawings. For the sake of brief description with reference to the drawings, the same or equivalent components may be denoted by the same reference numbers, and description thereof will not be repeated.

In general, suffixes such as "module" and "unit" may be used to refer to elements or components. Use of such suffixes herein is merely intended to facilitate description of the specification, and the suffixes do not have any special meaning or function.

Hereinafter, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, embodiments should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are only used to distinguish one element from another.

It will be understood that when an element is referred to as being "connected with" another element, there may be intervening elements present. In contrast, it will be understood that when an element is referred to as being "directly connected with" another element, there are no intervening elements present.

A singular representation may include a plural representation unless context clearly indicates otherwise.

Herein, it should be understood that the terms "comprises, includes," "has," etc. specify the presence of features, numbers, steps, operations, elements, components, or combinations thereof described in the specification, but do not preclude the presence or addition of one or more other features, numbers, steps, operations, elements, components, or combinations thereof.

Figure 1:
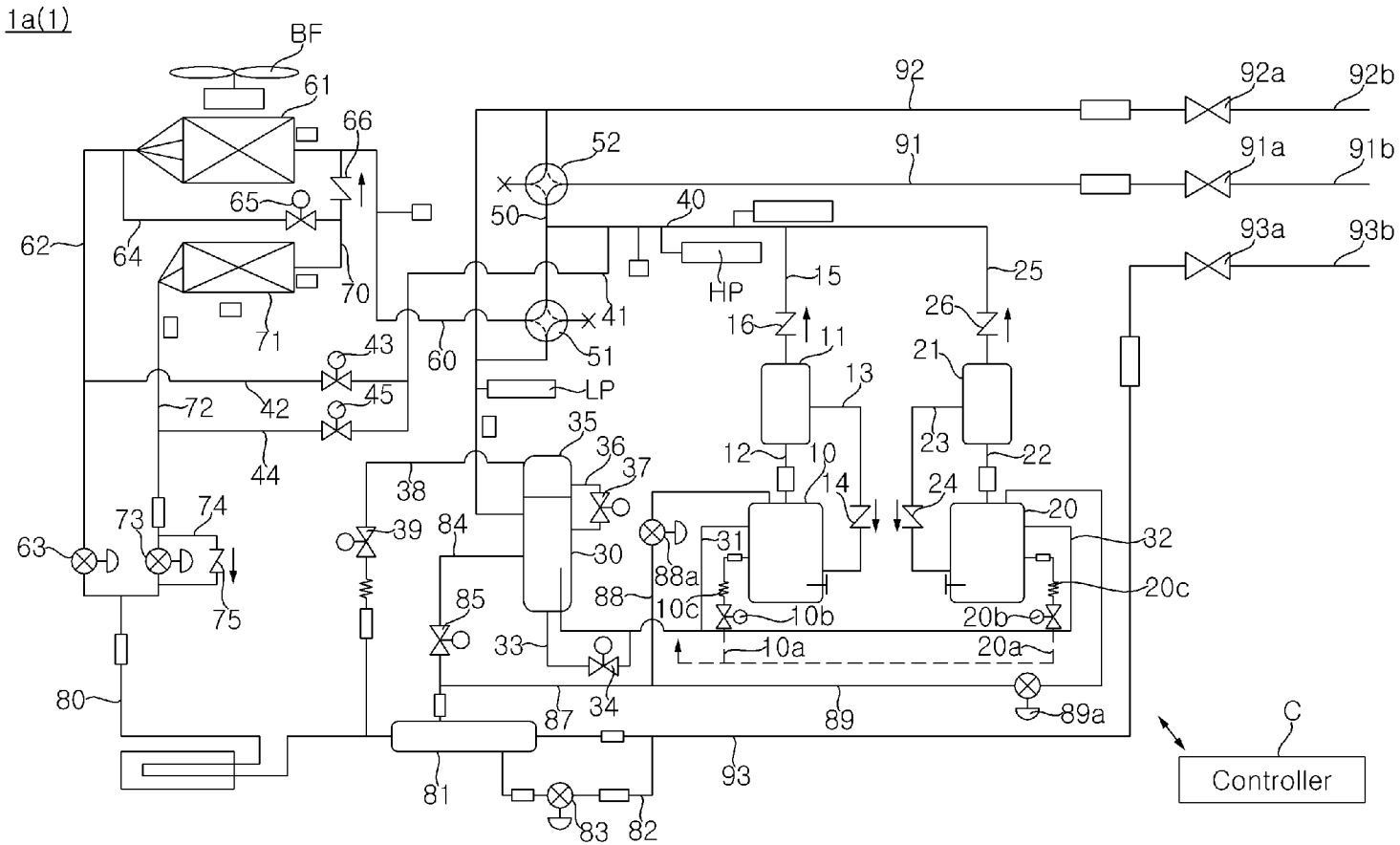
FIG. 1 is a schematic diagram of an outdoor unit of an air conditioner according to an embodiment.
Figure 2:
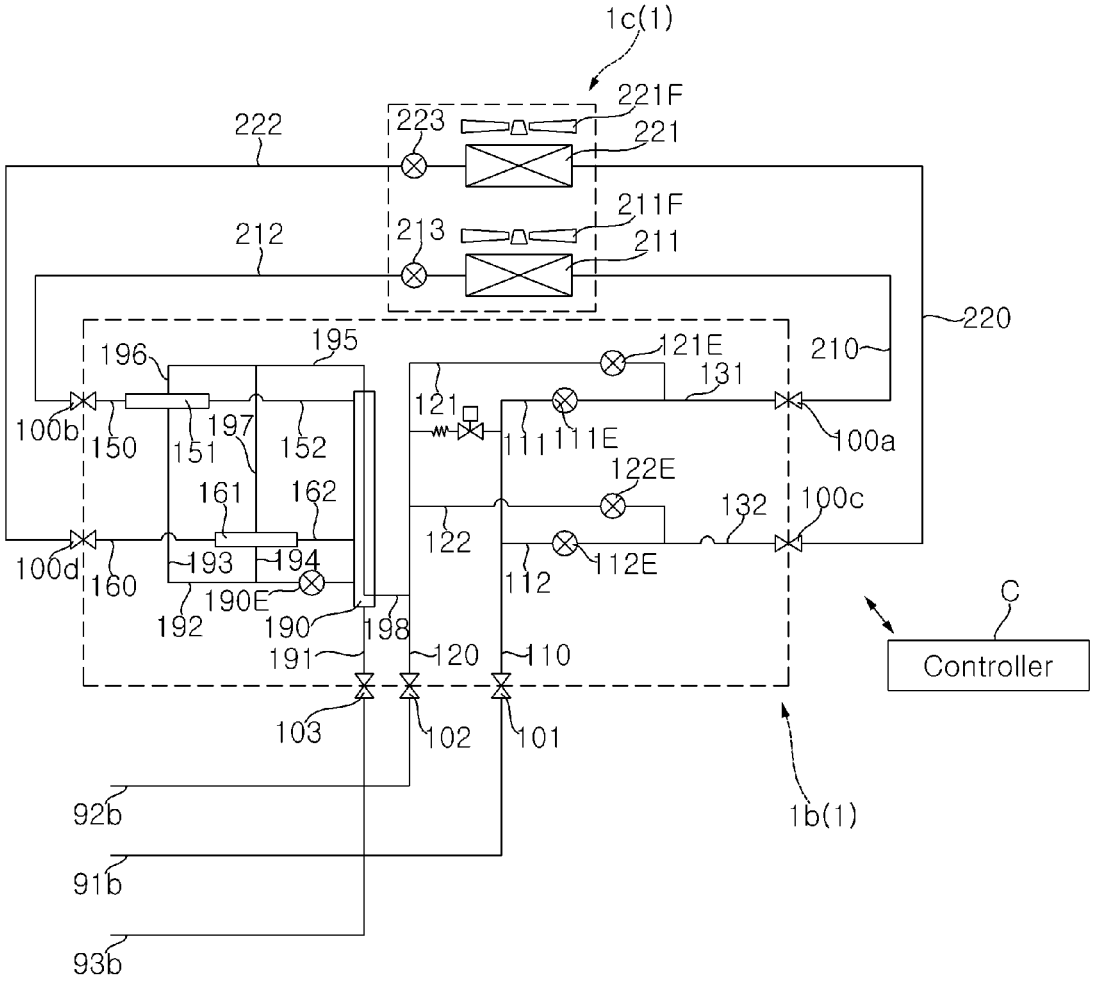
FIG. 2 is a schematic diagram of an indoor unit of the air conditioner according to the embodiment of FIG. 1.

Referring to FIGS. 1 and 2, an air conditioner 1 may include an outdoor unit 1*a*, a heat recovery unit 1*b*, and an indoor unit 1*c*. The outdoor unit 1*a* may include a compressor 10, 20, an oil separator 11, 21, an accumulator 30, a switching valve 51, 52, an outdoor heat exchanger 61, 71, and an outdoor expansion valve 63, 73.

The compressor 10, 20 may compress and discharge refrigerant at a high temperature and high pressure. The compressor 10, 20 may be an inverter compressor capable of controlling an amount of refrigerant and a discharge pressure of the refrigerant by adjusting an operating frequency. For example, the compressor 10, 20 may include first compressor 10 and second compressor 20. Alternatively, the number of compressors 10, 20 may be one, three, or more.

The oil separator 11, 21 may be connected to the compressor 10, 20 through a refrigerant pipe 12, 22 and an oil recovery pipe 13, 23. The refrigerant discharged from the first compressor 10 may flow into first oil separator 11 through first refrigerant pipe 12, and the oil flowing into the first oil separator 11 may be returned to the first compressor 10 through first oil recovery pipe 13. A first check valve 14 may be installed in the first oil recovery pipe 13, and fluid in the first oil recovery pipe 13 may flow from the first oil separator 11 to the first compressor 10. The refrigerant discharged from the second compressor 20 may flow into second oil separator 21 through second refrigerant pipe 22, and the oil flowing into the second oil separator 21 may be returned to the second compressor 20 through second oil recovery pipe 23. A second check valve 24 may be installed in the second oil recovery pipe 23, and fluid in the second oil recovery pipe 23 may flow from the second oil separator 21 to the second compressor 20.

The refrigerant passing through the first oil separator 11 may flow through a first refrigerant pipe 15 in which a first check valve 16 is installed, and the refrigerant passing through the second oil separator 21 may flow through a second refrigerant pipe 25 in which a second check valve 16 is installed. The refrigerant passing through the first refrigerant pipe 15 and the second refrigerant pipe 25 may flow through a discharge pipe 40, 50.

The accumulator 30 may provide gaseous refrigerant to the compressor 10, 20 through a refrigerant pipe 31, 32. One or a first end of the oil recovery pipe 33 may be connected to the accumulator 30, and the other or a second end of the oil recovery pipe 33 may be connected to the refrigerant pipe 31, 32. A control valve 34 may be installed in the oil recovery pipe 33 and may control a flow of oil in the oil recovery pipe 33.

The switching valve 51, 52 may switch a flow path of the refrigerant according to an operation mode of the air conditioner. The switching valve 51, 52 may be a four-way valve.

First switching valve 51 may be connected to the discharge pipe 40, 50, a first connection pipe 60, a low pressure pipe 92, and a closed pipe (see "X" near the first switching valve 51 in FIG. 1). The first connection pipe 60 may connect the first switching valve 51 and first outdoor heat exchanger 61, and the low pressure pipe 92 may provide low pressure refrigerant which has passed through the evaporator to the accumulator 30. The first switching valve 51 in a first state may guide the refrigerant in the discharge pipe 40, 50 to the first connection pipe 60 (see the solid line of the first switching valve 51 in FIG. 1). The first switching valve 51 in a second state switched from the first state may guide the refrigerant in the first connection pipe 60 to the low pressure pipe 92 (see the dotted line of first switching valve 51 in FIG. 1). The first connection pipe 60 may be referred to as connection pipe 60.

Second switching valve 52 may be connected to the discharge pipe 40, 50, a high pressure pipe 91, the low pressure pipe 92, and the closed pipe (see "X" near the second switching valve 52 in FIG. 1). The second switching valve 52 may guide the refrigerant in the discharge pipe 40, 50 to the high pressure pipe 91.

The outdoor heat exchanger 61, 71 may include a pipe through which refrigerant flows, and may exchange heat between a refrigerant and a heat transfer medium. A heat transfer direction between the refrigerant and the heat transfer medium in the outdoor heat exchanger 61, 71 may be different depending on the operation mode of the air conditioner. When the outdoor heat exchanger 61, 71 serves as a condenser, heat may be transferred from the refrigerant passing through the outdoor heat exchanger 61, 71 to the heat transfer medium, and the refrigerant may be condensed. When the outdoor heat exchanger 61, 71 serves as an evaporator, heat may be transferred from the heat transfer medium to the refrigerant passing through the outdoor heat exchanger 61, 71, and the refrigerant may be evaporated. For example, the heat transfer medium may be outdoor air. In this case, an outdoor fan BF may cause air to flow through the outdoor heat exchanger 61, 71. The number of outdoor heat exchanger 61, 71 may be one or two or more.

One or a first end of the first outdoor heat exchanger 61 may be connected to the first connection pipe 60, and the other or a second end of the first outdoor heat exchanger 61 may be connected to a first outdoor pipe 62. One or a first end of a variable bypass pipe 64 may be connected to the first outdoor pipe 62, and the other or a second end of the variable bypass pipe 64 may be connected to the first connection pipe 60. A variable valve 65 may be installed in the variable bypass pipe 64. A check valve 66 may be installed in the variable bypass pipe 64 at a location between the variable valve 65 and the other end of the variable bypass pipe 64, and may block the refrigerant in the first connection pipe 60 from passing through the variable bypass pipe 64.

One or a first end of the second outdoor heat exchanger 71 may be connected to the variable bypass pipe 64 at a position between the variable valve 65 and the check valve 66 through a second connection pipe 70. The other or a second end of the second outdoor heat exchanger 71 may be connected to the second outdoor pipe 72. One or a first end and the other or a second end of a bypass pipe 74 may be connected to the second outdoor pipe 72, and the check valve 75 may be installed in the bypass pipe 74. The second connection pipe 70 may be referred to as a connection pipe 70.

The outdoor expansion valve 63, 73 may include first outdoor expansion valve 63 and second outdoor expansion valve 73. The first outdoor expansion valve 63 may be installed in the first outdoor pipe 62 and may expand the refrigerant flowing through the first outdoor pipe 62. The second outdoor expansion valve 73 may be installed in the second outdoor pipe 72 and expand the refrigerant flowing through the second outdoor pipe 72. The outdoor expansion valves 63, 73 may each be an Electronic Expansion Valve (EEV).

A supercooling pipe 80 may connect the outdoor expansion valve 63, 73 and a supercooler 81. A liquid pipe 93 may be opposite to the supercooling pipe 80 with respect to the supercooler 81, and may be connected to the supercooler 81. One or a first end of a supercooling bypass pipe 82 may be connected to the liquid pipe 93, and the other or a second end of the supercooling bypass pipe 82 may be connected to the supercooler 81.

A part or portion of the refrigerant in the liquid pipe 93 may be expanded by a supercooling expansion valve 83 installed in the bypass pipe 82 and may pass through the supercooler 81. The refrigerant evaporated while passing through the supercooler 81 may be supplied to the compressor 10, 20 through a refrigerant pipe 87, 88, 89. An expansion valve 88*a*, 89*a* may be installed in the refrigerant pipe 88, 89 to expand the refrigerant passing through the refrigerant pipe 88, 89. A bypass pipe 84 in which a bypass valve 85 is installed may have one or a first end connected to the accumulator 30 and the other or a second end connected to the refrigerant pipe 87. When the bypass valve 85 is opened, liquid refrigerant in the accumulator 30 may be expanded by the expansion valve 88*a*, 89*a* in the refrigerant pipe 87, 88, 89 and flow into the compressor 10, 20. The supercooling expansion valve 83 and the expansion valve 88*a*, 89*a* may each be an electronic expansion valve (EEV).

The rest of the refrigerant in the liquid pipe 93 may be supercooled while passing through the supercooler 81. The supercooled refrigerant may pass through the supercooling pipe 80.

A receiver 35 may store refrigerant. A first receiver connection pipe 36 may connect the receiver 35 and the accumulator 30, and a first valve 37 may be installed in the first receiver connection pipe 36 and be opened or closed. A second receiver connection pipe 38 may connect the receiver 35 and the supercooling pipe 80, and a second valve 39 may be installed in the second receiver connection pipe 38 and be opened or closed. The first and second valves 37 and 39 may adjust an amount of refrigerant circulated through the refrigerant pipe.

The indoor unit 1*c* may include an indoor heat exchanger 211, 221 and an indoor expansion valve 213, 223. The indoor heat exchanger 211, 221 may include a pipe through which the refrigerant flows, and may exchange heat between the refrigerant and the heat transfer medium. The direction of heat transfer between the refrigerant and the heat transfer medium in the indoor heat exchanger 211, 221 may vary depending on the operation mode of the air conditioner. When the indoor heat exchanger 211, 221 serves as an evaporator, heat may be transferred from the heat transfer medium to the refrigerant passing through the indoor heat exchanger 211, 221, and the refrigerant may be evaporated. When the indoor heat exchanger 211, 221 serves as an a condenser, heat may be transferred from the refrigerant passing through the indoor heat exchanger 211, 221 to the heat transfer medium, and the refrigerant may be condensed. For example, the heat transfer medium may be indoor air. In this case, an indoor fan 211F, 221F may cause air to flow through the indoor heat exchanger 211, 221. For another example, the heat transfer medium may be water. In this case, the water passing through the indoor heat exchanger 211, 221 may be supplied to a radiator or pipe installed in a room to cool or heat the room, or may be supplied to a water tank to provide cold or hot water to the room. The number of indoor heat exchanger 211, 221 may be one, or two or more.

One or a first end of a first indoor heat exchanger 211 may be connected to a first connection pipe 210, and the other or a second end of the first indoor heat exchanger 211 may be connected to a first indoor pipe 212. One or a first end of a second indoor heat exchanger 221 may be connected to a second connection pipe 220, and the other or a second end of the second indoor heat exchanger 221 may be connected to a second indoor pipe 222.

The indoor expansion valve 213, 223 may include first indoor expansion valve 213 and second indoor expansion valve 223. The first indoor expansion valve 213 may be installed in the first indoor pipe 212 and expand the refrigerant flowing through the first indoor pipe 212. The second indoor expansion valve 223 may be installed in the second indoor pipe 222, and may expand the refrigerant flowing through the second indoor pipe 222. The indoor expansion valve 213, 223 may be an electronic expansion valve (EEV).

The heat recovery unit 1*b* may connect the outdoor unit 1*a* and the indoor unit 1*c* through a refrigerant pipe. The heat recovery unit 1*b* may include a distributor and a supercooler.

A high pressure connection pipe 91*b* may be connected to the high pressure pipe 91 of the outdoor unit 1*a* through a first connection valve 91*a*, and may be connected to a high pressure pipe 110 of the heat recovery unit 1*b* through a second connection valve 101. The high pressure pipe 91, the high pressure connection pipe 91*b*, and the high pressure pipe 110 may be a gas pipe through which high pressure gaseous refrigerant flows. A first high pressure valve 111E may be installed in a first high pressure pipe 111 of the high pressure pipe 110, and an opening degree of the first high pressure valve 111E may be adjusted. A second high pressure valve 112E may be installed in the second high pressure pipe 112 of the high pressure pipe 110, and an opening degree of the second high pressure valve 112E may be adjusted. The first and second high pressure valves 111E and 112E may each be an electronic expansion valve (EEV). The first and second high pressure valves 111E and 112E may each be a large-capacity EEV having a large flow coefficient. The first and second high pressure pipes 111 and 112 may be referred to as first and second refrigerant pipes 111 and 112. The first and second high pressure valves 111E and 112E may be referred to as first and second control valves 111E and 112E.

A low pressure connection pipe 92*b* may be connected to the low pressure pipe 92 of the outdoor unit 1*a* through a first connection valve 92*a*, and may be connected to a low pressure pipe 120 of the heat recovery unit 1*b* through a second connection valve 102. The low pressure pipe 92, the low pressure connection pipe 92*b*, and the low pressure pipe 120 may be a gas pipe through which low pressure gaseous refrigerant flows. A first low pressure valve 121E may be installed in a first low pressure pipe 121 of the low pressure pipe 120, and an opening degree of the first low pressure valve 121E may be adjusted. A second low pressure valve 122E may be installed in a second low pressure pipe 122 of the low pressure pipe 120, and an opening degree of the second low pressure valve 122E may be adjusted. The first and second low pressure valves 121E and 122E may each be an electronic expansion valve (EEV). The first and second low pressure valves 121E and 122E may each be a large-capacity EEV having a large flow coefficient. The first and second low pressure pipes 121 and 122 may be referred to as first and second connection pipes 121 and 122. The first and second low pressure valves 121E and 122E may be referred to as first and second variable valves 121E and 122E. The number of each of the high pressure valve 111E, 112E and the low pressure valve 121E, 122E may be the same as the number of indoor heat exchanger 211, 221. The number of indoor heat exchanger 211, 221 may be one, or two or more.

A liquid connection pipe 93*b* may be connected to the liquid pipe 93 of the outdoor unit 1*a* through a first connection valve 93*a*, and may be connected to a liquid pipe 191 of the heat recovery unit 1*b* through a second connection valve 103. The liquid pipe 93, the liquid connection pipe 93*b*, and the liquid pipe 191 may be a liquid pipe through which medium pressure liquid refrigerant flows.

The first high pressure pipe 111 of the high pressure pipe 110 and the first low pressure pipe 121 of the low pressure pipe 120 may be connected to a first refrigerant pipe 131. The first refrigerant pipe 131 may be connected to the first connection pipe 210 through a first valve 100*a*. The second high pressure pipe 112 of the high pressure pipe 110 and the second low pressure pipe 122 of the low pressure pipe 120 may be connected to a second refrigerant pipe 132. The second refrigerant pipe 132 may be connected to the second connection pipe 220 through a third valve 100*c*.

A supercooler 151, 161 may connect the indoor pipe 212, 222 and the liquid connection pipe 93*b*. One or a first end of a first supercooling pipe 150 may be connected to first supercooler 151, and the other or a second end of the first supercooling pipe 150 may be connected to the first indoor pipe 212 through a second valve 100*b*. A first pipe 152 may connect a header 190 and the first supercooler 151. One or a first end of a second supercooling pipe 160 may be connected to second supercooler 161, and the other or a second end of the second supercooling pipe 160 may be connected to the second indoor pipe 222 through a fourth valve 100*d*. A second pipe 162 may connect the header 190 and the second supercooler 161.

One or a first end of the liquid pipe 191 of the heat recovery unit 1*b* may be connected to the liquid connection pipe 93*b* through the second connection valve 103, and the other or a second end of the liquid pipe 191 of the heat recovery unit 1*b* may be connected to the header 190. One or a first end of a supercooling bypass pipe 192 may be connected to the header 190, and the other or a second end of the supercooling bypass pipe 192 may be connected to the supercooler 151, 161 (see reference numerals 193 and 194 in FIG. 2). A supercooling expansion valve 190E may be installed in the supercooling bypass pipe 192, and expand the refrigerant flowing through the supercooling bypass pipe 192. The supercooling expansion valve 190E may be an electronic expansion valve (EEV).

One or a first end of an evaporation pipe 195 of the heat recovery unit 1*b* may be connected to the supercooler 151, 161 (see reference numerals 196 and 197 in FIG. 2), and the other or a second end of the evaporation pipe 195 may be connected to the low pressure pipe 120.

Accordingly, a part or portion of the refrigerant in the liquid pipe 191 flows through the supercooling bypass pipe 192, and may be expanded by the supercooling expansion valve 190E, and evaporated while passing through the supercooler 151, 161. The evaporated refrigerant may be provided to the low pressure pipe 120 via the evaporation pipe 195 and the header 190. The rest of the refrigerant in the liquid pipe 191 may flow through the pipe 152, 162 and may be cooled while passing through the supercooler 151, 161. The cooled refrigerant may be supplied to the indoor heat exchanger 211, 221 via the supercooling pipe 150, 160, the indoor pipe 212, 222, and the indoor expansion valve 213, 223.

Figure 3A:
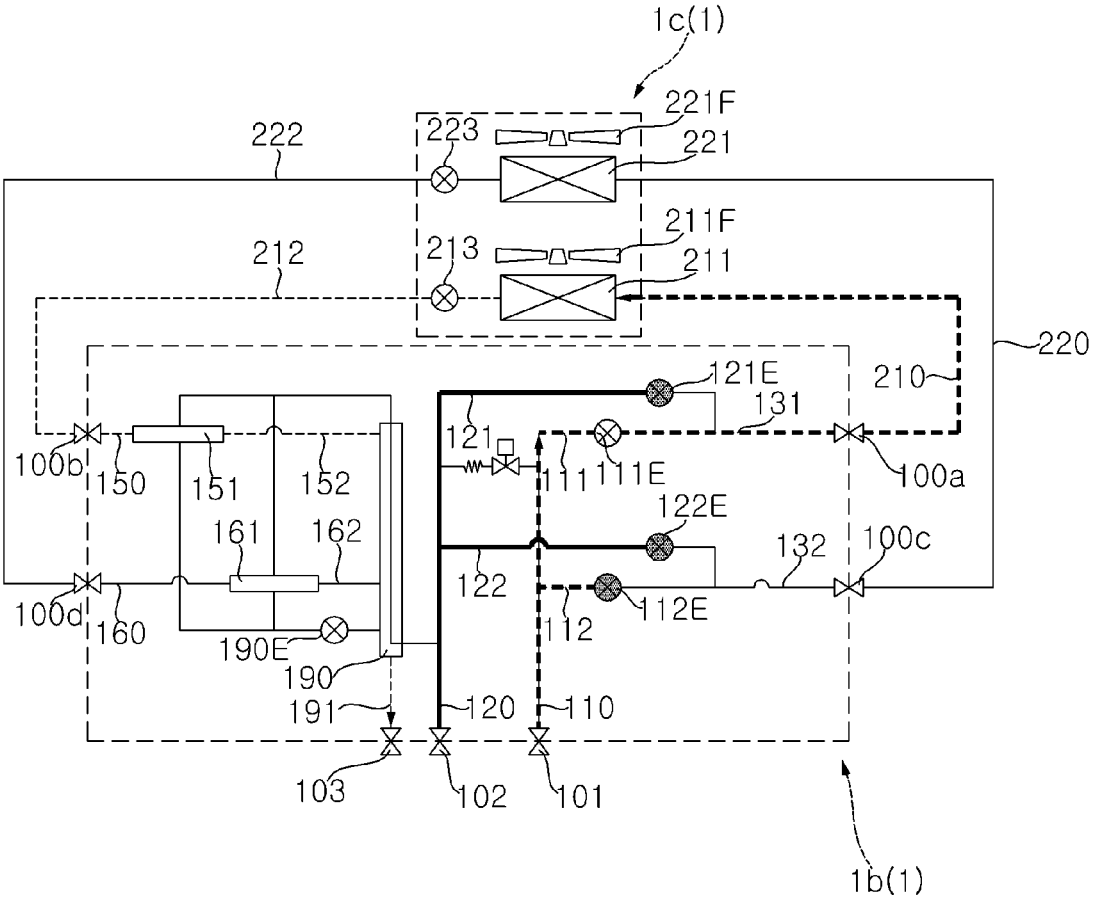
FIGS. 3A and 3B are schematic diagrams for explaining a heating operation and a cooling operation of the air conditioner according to the embodiment of FIG. 1.
Figure 3B:
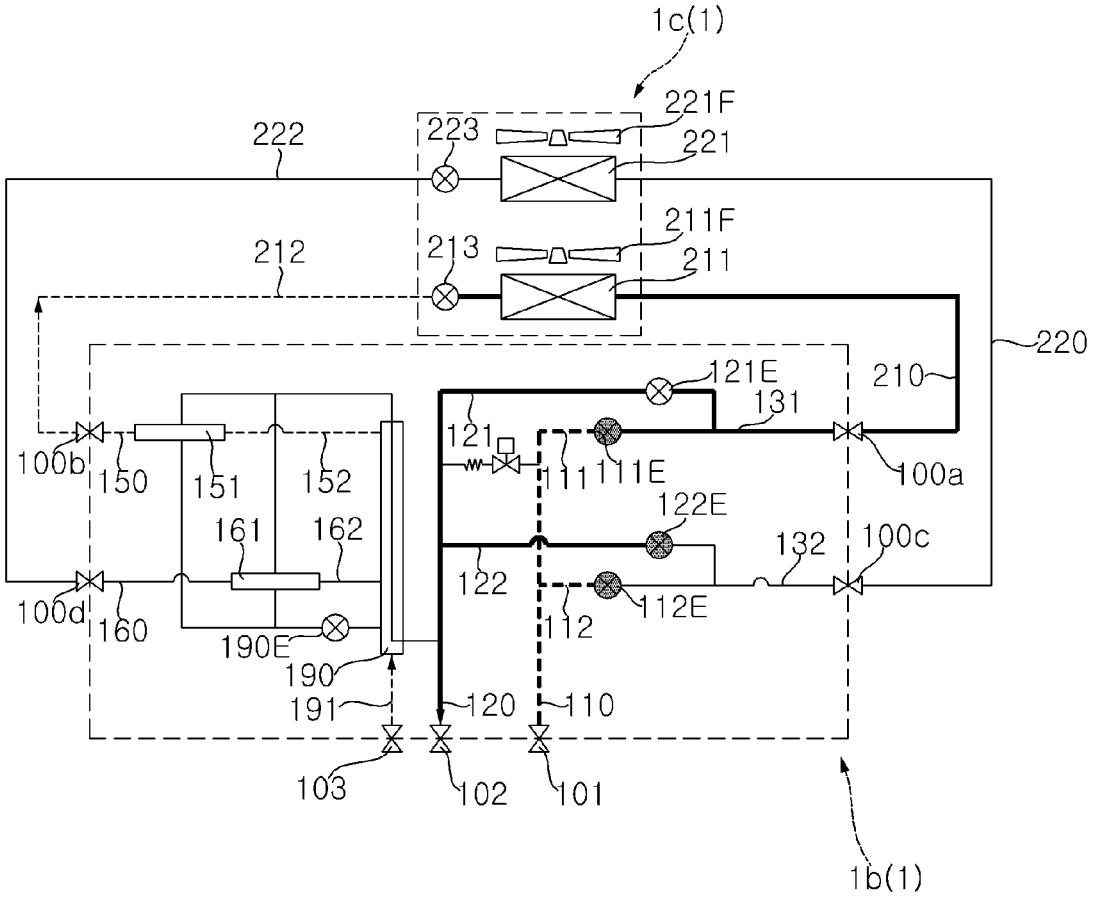

Referring to FIG. 3, the air conditioner may perform a heating operation (see FIG. 3A)) or a cooling operation (see FIG. 3B). For example, the indoor heat exchanger(s) may serve as a condenser or an evaporator. As another example, among the indoor heat exchangers, an indoor heat exchanger installed in an indoor space requiring heating may serve as a condenser, and an indoor heat exchanger installed in an indoor space requiring cooling may serve as an evaporator. As another example, among indoor heat exchangers, an indoor heat exchanger installed in an indoor space requiring heating or cooling may serve as a condenser or an evaporator, and an indoor heat exchanger installed in an indoor space not requiring heating or cooling may be inoperative.

Referring to FIG. 3A, the first high pressure valve 111E and the first indoor expansion valve 213 may be opened. The first low pressure valve 121E, the second low pressure valve 122E, and the second high pressure valve 112E may be closed.

The high-temperature, high pressure refrigerant discharged from the compressor 10, 20 may flow into the high pressure pipe 110 (see FIGS. 1 and 2) via the oil separator 11, 21, the second switching valve 52, the high pressure pipe 91, and the high pressure connection pipe 91*b*. The refrigerant in the high pressure pipe 110 may flow into the first indoor heat exchanger 211 through the first high pressure valve 111E and the first valve 100*a*, and may be condensed while passing through the first indoor heat exchanger 211. Accordingly, the indoor space in which the first indoor heat exchanger 211 is installed may be heated. The first indoor expansion valve 213 may control a degree of supercooling. The degree of supercooling is a difference between a saturation temperature corresponding to the condensing pressure of the first indoor heat exchanger 211 and an outlet temperature of the first indoor heat exchanger 211.

The condensed refrigerant flows into the liquid pipe 93 via the first indoor expansion valve 213, the second valve 100*b*, the first supercooler 151, the header 190, and the liquid connection pipe 93*b* (see FIGS. 1 and 2). The refrigerant in the liquid pipe 93 may be cooled while passing through the supercooler 81, expanded by the outdoor expansion valve 63, 73, and evaporated while passing through the outdoor heat exchanger 61, 71.

The evaporated refrigerant may be returned to the compressor 10, 20 via the first connection pipe 60, the first switching valve 51, the low pressure pipe 92, and the accumulator 30. Accordingly, a heating cycle of the air conditioner using the first indoor heat exchanger 211 may be completed.

Referring to FIG. 3B, the first low pressure valve 121E and the first indoor expansion valve 213 may be opened. The first high pressure valve 111E, the second low pressure valve 122E, and the second high pressure valve 112E may be closed.

The high-temperature, high pressure refrigerant discharged from the compressor 10, 20 may flow into the first connection pipe 60 via the oil separator 11, 21 and the first switching valve 51, and the refrigerant in the first connection pipe 60 may be condensed while passing through the outdoor heat exchanger 61, 71 (see FIGS. 1 and 2). The condensed refrigerant may flow into the liquid pipe 191 via the outdoor expansion valve 63, 73, the supercooler 81, the liquid pipe 93, and the liquid connection pipe 93*b* (see FIGS. 1 and 2). The refrigerant in the liquid pipe 191 may be cooled while passing through the first supercooler 151, expanded while passing through the first indoor expansion valve 213, and evaporated while passing through the first indoor heat exchanger 211. Accordingly, the indoor space in which the first indoor heat exchanger 211 is installed may be cooled. The first indoor expansion valve 213 may control the degree of superheat. The degree of superheat is a difference between the temperature of the refrigerant suctioned into the compressor 10, 20 (or the temperature of the refrigerant at the outlet side of the first indoor heat exchanger 211) and a saturation temperature corresponding to the evaporating pressure of the first indoor heat exchanger 211 (or a temperature of the refrigerant at an inlet side of the first indoor heat exchanger 211).

The evaporated refrigerant may be returned to the compressor 10, 20 via the first valve 100*a*, the first low pressure valve 121E, the low pressure pipe 120, the low pressure connection pipe 92*b*, the low pressure pipe 92, and the accumulator 30. Accordingly, the cooling cycle of the air conditioner using the first indoor heat exchanger 211 may be completed.

Figure 4:
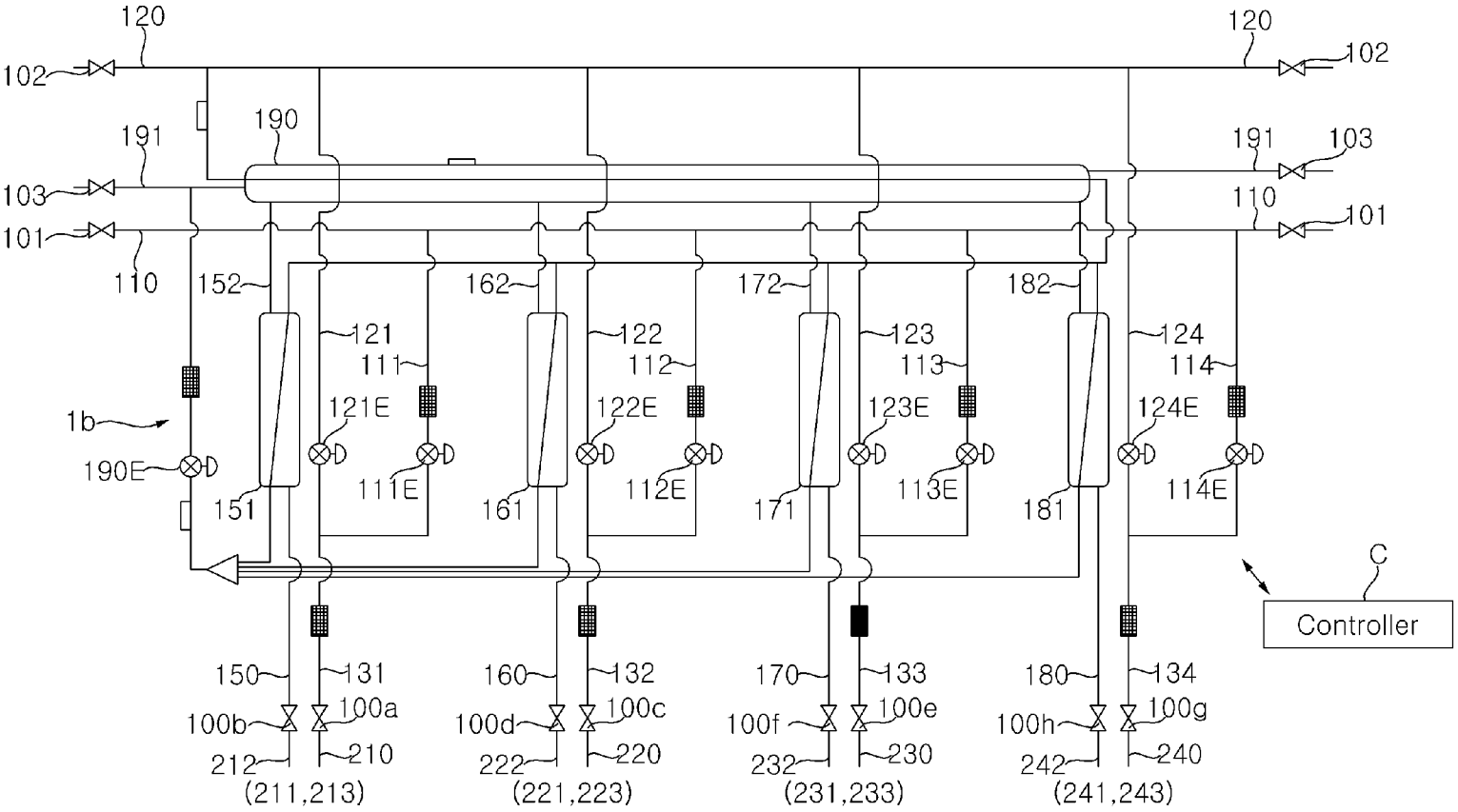
FIGS. 4 and 5 are schematic diagrams of the air conditioner of FIG. 1 for explaining a configuration in which evaporation pressure is differently adjusted for each indoor heat exchanger by adjusting an opening degree of a variable valve.

Referring to FIG. 4, four indoor heat exchangers 211, 221, 231, and 241 may be connected to the heat recovery unit 1*b*.

For example, the air conditioner may perform a heating operation using four indoor heat exchangers 211, 221, 231, and 241. The first to fourth high pressure valves 111E, 112E, 113E, and 114E may be opened, and the first to fourth low pressure valves 121E, 122E, 123E, and 124E may be closed. The first to fourth high pressure valves 111E, 112E, 113E, and 114E may be referred to as first to fourth control valves 111E, 112E, 113E, and 114E. The first to fourth low pressure valves 121E, 122E, 123E, and 124E may be referred to as first to fourth variable valves 121E, 122E, 123E, and 124E.

Further, the refrigerant of high pressure pipe 110 may flow into the first to fourth indoor heat exchangers 211, 221, 231, 241 through the first to fourth high pressure valves 111E, 112E, 113E, and 114E and first to fourth connection pipes 210, 220, 230, and 240, and may be condensed while passing through the first to fourth indoor heat exchangers 211, 221, 231, 241. Accordingly, the indoor space in which the first to fourth indoor heat exchangers 211, 221, 231, and 241 are installed may be heated. The condensed refrigerant may be provided to the liquid pipe 191 via the first to fourth indoor expansion valves 213, 223, 233, and 243, the first to fourth indoor pipes 212, 222, 232, and 242, and the first to fourth supercoolers 151, 161, 171, 181.

For example, the air conditioner may perform a heating operation using the first and second indoor heat exchangers 211 and 221, and perform a cooling operation using the third and fourth indoor heat exchangers 231 and 241. The first and second high pressure valves 111E and 112E may be opened, and the first and second low pressure valves 121E and 122E may be closed. The third and fourth low pressure valves 123E and 124E may be opened, and the third and fourth high pressure valves 113E and 114E may be closed.

In addition, the refrigerant of the high pressure pipe 110 may flow into the first and second indoor heat exchangers 211 and 221 through the first and second high pressure valves 111E and 112E and the first and second connection pipes 210 and 220, and may be condensed while passing through the first and second indoor heat exchangers 211 and 221. Thus, the indoor space in which the first and second indoor heat exchanger 211, 221 are installed may be heated. The condensed refrigerant may be provided to the liquid pipe 191 via the first and second indoor expansion valve 213 and 223, the first and second indoor pipes 212 and 222, and the first and second supercoolers 151 and 161.

In addition, the refrigerant in the liquid pipe 191 may be cooled while passing through third and fourth supercoolers 171 and 181. The cooled refrigerant may pass through third and fourth supercooling pipes 170 and 180 and third and fourth indoor pipes 232 and 242, be expanded by third and fourth indoor expansion valves 233 and 243, and be evaporated while passing through the third and fourth indoor heat exchangers 231 and 241. Thus, the indoor space in which the third and fourth indoor heat exchangers 231 and 241 are installed may be cooled. The evaporated refrigerant may be supplied to the low pressure pipe 120 via the third and fourth connection pipes 230 and 240 and the third and fourth low pressure valves 123E and 124E.

The air conditioner may perform a cooling operation using four indoor heat exchangers 211, 221, 231, and 241.

Figure 5:
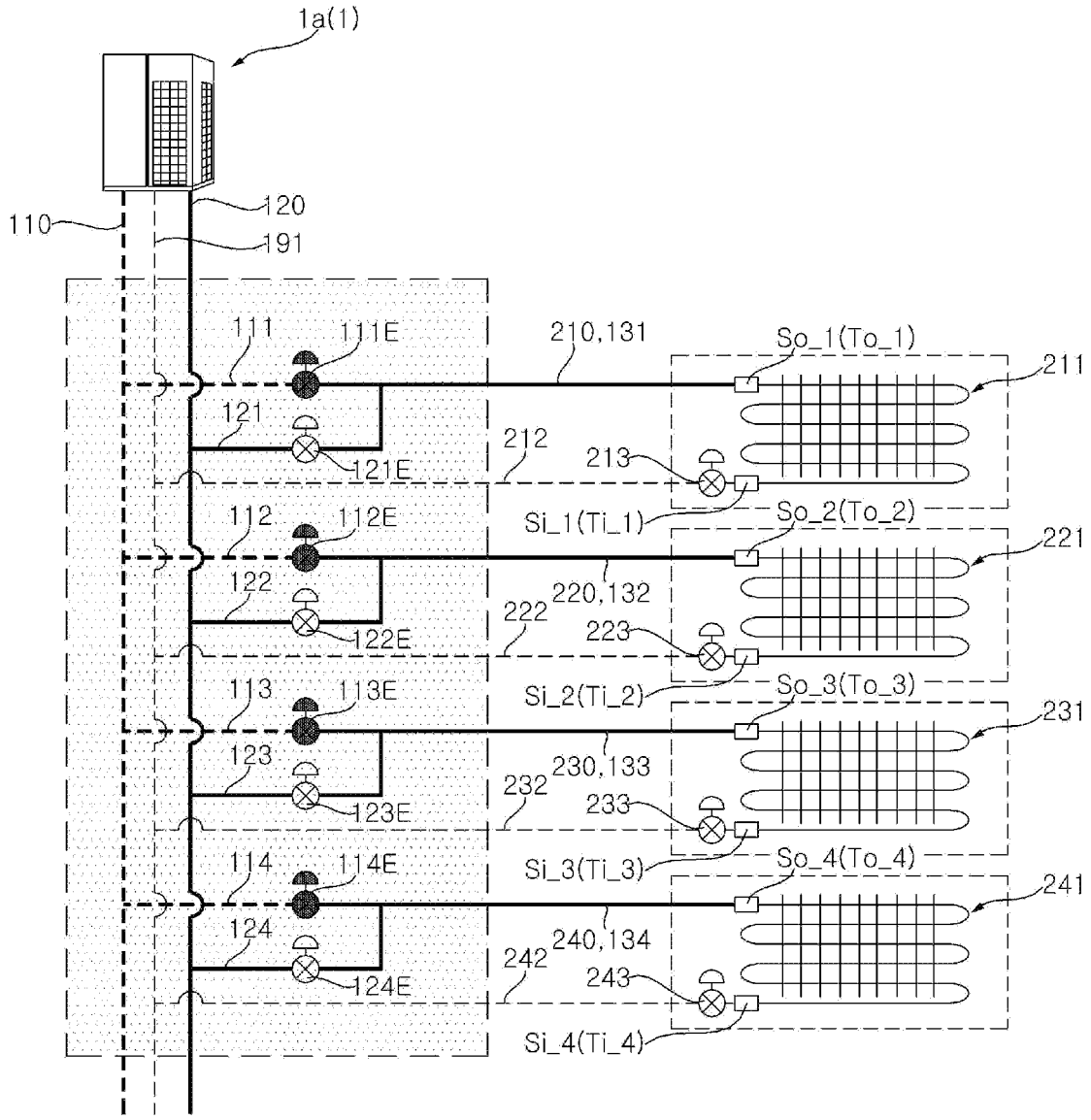

Referring to FIGS. 4 and 5, the plurality of indoor heat exchangers 211, 221, 231, and 241 may serve as an evaporator, and may have the same or different evaporation pressures. The plurality of low pressure valves 121E, 122E, 123E, and 124E and the plurality of indoor expansion valves 213, 223, 233, and 243 may be opened, and the plurality of high pressure valves 111E, 112E, 113E, and 114E may be closed.

The high-temperature, high-pressure refrigerant discharged from the compressor 10, 20 may flow into the first connection pipe 60 via the oil separator 11, 21 and the first switching valve 51, and the refrigerant in the first connection pipe 60 may be condensed while passing through the outdoor heat exchanger 61, 71 (see FIGS. 1 and 2). The condensed refrigerant may flow into the liquid pipe 191 via the outdoor expansion valve 63, 73, the supercooler 81, the liquid pipe 93, and the liquid connection pipe 93*b* (see FIGS. 1 and 2).

The refrigerant in the liquid pipe 191 may be cooled while passing through the plurality of supercoolers 151, 161, 171, and 181. The cooled refrigerant may pass through the plurality of supercooling pipes 150, 160, 170, and 180, be expanded by the plurality of indoor expansion valves 213, 223, 233, and 243, and be evaporated while passing through the plurality of indoor heat exchangers 211, 221, 231, and 241. Thus, the indoor space in which the plurality of indoor heat exchangers 211, 221, 231, and 241 are installed may be cooled. The evaporated refrigerant may be provided to the low pressure pipe 120 via the plurality of connection pipes 210, 220, 230, and 240 and the plurality of low pressure valves 121E, 122E, 123E, and 124E.

The refrigerant in the low pressure pipe 120 may be returned to the compressor 10, 20 via the low pressure pipe 92 and the accumulator 30 (see FIGS. 1 and 2). Accordingly, the cooling cycle of the air conditioner using the plurality of indoor heat exchangers 211, 221, 231, and 241 may be completed.

In this case, each of the plurality of indoor expansion valves 213, 223, 233, and 243 may control the degree of superheat of each of the plurality of indoor heat exchangers 211, 221, 231, and 241. The degree of superheat is a difference between the temperature of the refrigerant suctioned into the compressor 10, 20 (or the temperature of the refrigerant at the outlet side of each indoor heat exchanger) and the saturation temperature corresponding to the evaporation pressure of each indoor heat exchanger (or the temperature of the refrigerant at the inlet side of each indoor heat exchanger). For example, the temperature (To_1, To_2, To_3, and To_4) of the refrigerant at the outlet side of each of the plurality of indoor heat exchangers 211, 221, 231, and 241 may be measured by each of the plurality of temperature sensors (So_1, So_2, So_3, and So_4).

When the compressor 10, 20 of the outdoor unit 1*a* operates at a specific operating frequency, the pressure of the refrigerant suctioned into the compressor 10, 20 may be constant. In this case, the evaporation pressure of each of the plurality of indoor heat exchangers 211, 221, 231, and 241 may be adjusted by adjusting the opening degree of each of the plurality of low pressure valves 121E, 122E, 123E, and 124E. In addition, the refrigerant that passes through each of the plurality of indoor expansion valves 213, 223, 233, and 243, and flows into the inlet of each of the plurality of indoor heat exchangers 211, 221, 231, and 241 has a two-phase state. Thus, it may be said that the temperature of the refrigerant at the inlet side of each of the plurality of indoor heat exchangers 211, 221, 231, and 241 may be adjusted by adjusting the opening degree of each of the plurality of low pressure valves 121E, 122E, 123E, 124E. This may be expressed as in Equation 1 below.

$$L1=f(Ti_1),L2=f(Ti_2),L3=f(Ti_3),L4=f(Ti_4) \quad \text{Equation 1:}$$

Here, L1 is the opening degree of the first low pressure valve 121E, and Ti_1 is the temperature of the refrigerant at the inlet side of the first indoor heat exchanger 211, which may be measured by a first temperature sensor Si_1. L2 is the opening degree of the second low pressure valve 122E, and Ti_2 is the temperature of the refrigerant at the inlet side of the second indoor heat exchanger 221, which may be measured by a second temperature sensor Si_2. L3 is the opening degree of the third low pressure valve 123E, and Ti_3 is the temperature of the refrigerant at the inlet side of the third indoor heat exchanger 231, which may be measured by a third temperature sensor Si_3. L4 is the opening degree of the fourth low pressure valve 124E, and Ti_4 is the temperature of the refrigerant at the inlet side of the fourth indoor heat exchanger 241, which may be measured by a fourth temperature sensor Si_4. Alternatively, more specifically, the opening degree of the low pressure valve described above and hereinafter may be adjusted based on the pressure of the refrigerant at the inlet side of the indoor heat exchanger measured by a pressure sensor.

In this case, if the pressure drop of the refrigerant in the refrigerant pipe connecting the indoor heat exchanger and the compressor is excluded from being considered, the evaporation pressure of the indoor heat exchanger 211, 221, 231, 241 connected to the fully opened low pressure valves 121E, 122E, 123E, 124E may be the same as the pressure of the refrigerant at the inlet side of the compressor 10, 20. In addition, as the opening degree of the low pressure valves 121E, 122E, 123E, 124E decreases, the evaporation pressure of the indoor heat exchanger 211, 221, 231, 241 connected thereto increases and may be greater than the pressure (fixed value) of the refrigerant at the inlet side of the compressor 10, 20.

Accordingly, the controller C of the air conditioner adjusts the opening degree of each of the plurality of low pressure valves 121E, 122E, 123E, and 124E, thereby adjusting the temperature (or pressure) of the refrigerant at the inlet side of each of the plurality of indoor heat exchangers 211, 221, 231, and 241. In other words, in order to adjust the temperature (or pressure) of the refrigerant at the inlet side of each of the plurality of indoor heat exchangers 211, 221, 231, and 241 to the target temperature (or target pressure), the opening degree of each of the plurality of low pressure valves 121E, 122E, 123E, 124E may be adjusted. As a result, the temperature (blowdown temperature) of indoor air supplied to the cooling space through each of the plurality of indoor heat exchangers 211, 221, 231, and 241 may be adjusted for each indoor heat exchanger.

For example, the opening degree of the second low pressure valve 122E may be smaller than the opening degree of the first low pressure valve 121E, and larger than the opening degree of the third low pressure valve 123E. The opening degree of the fourth low pressure valve 124E may be smaller than the opening degree of the third low pressure valve 123E. Based on a case in which the indoor heat exchangers have the same superheat, the blowdown temperature may be higher in the order of the fourth indoor heat exchanger 241, the third indoor heat exchanger 231, the second indoor heat exchanger 221, and the first indoor heat exchanger 211.

Figure 6:
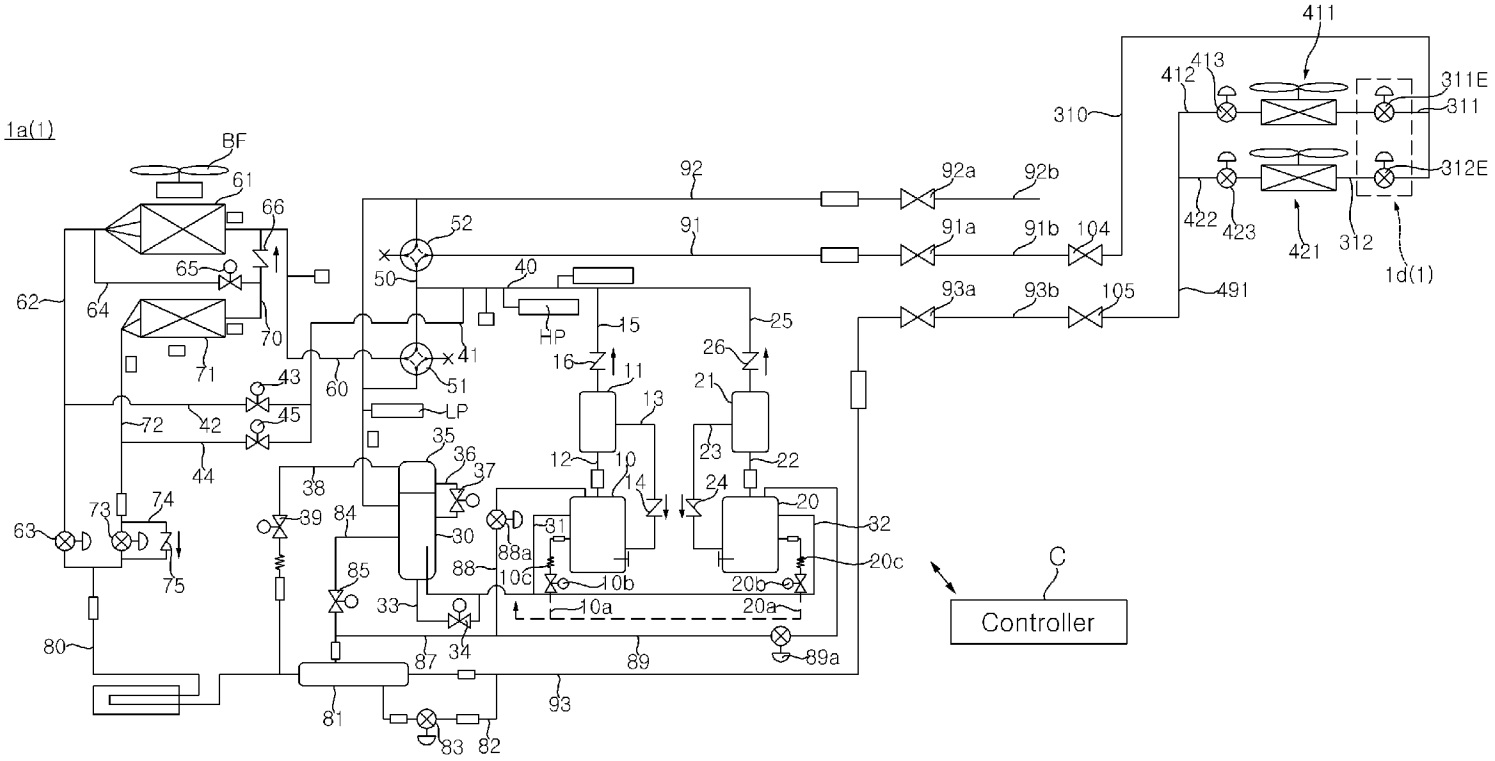
FIGS. 6 and 7 are schematic diagrams of an air conditioner according to another embodiment for explaining a configuration in which evaporation pressure is differently adjusted for each indoor heat exchanger by adjusting an opening degree of a variable valve.

Referring to FIG. 6, unlike the above with reference to FIGS. 1 to 5, the heat recovery unit 1*b* may be omitted, and the plurality of indoor heat exchangers 411 and 421 may be connected to the outdoor unit 1*a* through the refrigerant pipe. For example, the number of indoor heat exchangers 411 and 421 may be 2 or 4 (see FIG. 7), or 3 or 5 or more.

The gas pipe 91*b* may be connected to a gaseous refrigerant connection pipe 310 through a second connection valve 104. The liquid pipe 93*b* may be connected to a liquid refrigerant connection pipe 491 through a second connection valve 105. A first indoor heat exchanger 411 may connect a first connection pipe 311 of the gaseous refrigerant connection pipe 310 and a first connection pipe 412 of the liquid refrigerant connection pipe 491. A second indoor heat exchanger 421 may connect a second connection pipe 312 of the gaseous refrigerant connection pipe 310 and a second connection pipe 422 of the liquid refrigerant connection pipe 491.

A first indoor expansion valve 413 may be installed in the first connection pipe 412, and expand the refrigerant flowing through the first connection pipe 412. A second indoor expansion valve 423 may be installed in the second connection pipe 422, and may expand the refrigerant flowing through the second connection pipe 422. The indoor expansion valves 413, 423 may be electronic expansion valves (EEVs).

A first low pressure valve 311E may be installed in the first connection pipe 311, and the opening degree of the first low pressure valve 311E may be adjusted. A second low pressure valve 312E may be installed in the second connection pipe 312, and the opening degree of the second low pressure valve 312E may be adjusted. The low pressure valve 311E, 312E may be Electronic Expansion Valves (EEVs). The low pressure valves 311E, 312E may be large-capacity EEVs having a large flow coefficient. The low pressure valves 311E and 312E and the refrigerant pipes in which they are installed may constitute an evaporation pressure control device 1*d*. The low pressure valve 311E, 312E may be referred to as a variable valve 311E, 312E.

The high-temperature, high-pressure refrigerant discharged from the compressor 10, 20 may flow into the gaseous refrigerant connection pipe 310 via the oil separator 11, 21, the second switching valve 52, the high pressure pipe 91, and the gas pipe 91*b*. The refrigerant of the gaseous refrigerant connection pipe 310 may be condensed while passing through the first and second indoor heat exchangers 411 and 421. Accordingly, the indoor space in which the first and second indoor heat exchangers 411 and 421 are installed may be heated. The first and second indoor expansion valves 413 and 423 may control the degree of supercooling. The degree of supercooling is a difference between the saturation temperature corresponding to the condensation pressure of the first and second indoor heat exchangers 411 and 421 and the outlet temperature of the first and second indoor heat exchangers 411 and 421.

The condensed refrigerant may flow into the liquid pipe 93*b* through the liquid refrigerant connection pipe 491. The refrigerant in the liquid pipe 93 may be cooled while passing through the supercooler 81, expanded by the outdoor expansion valve 63, 73, and evaporated while passing through the outdoor heat exchanger 61, 71.

The evaporated refrigerant may be returned to the compressor 10, 20 via the first connection pipe 60, the first switching valve 51, the low pressure pipe 92, and the accumulator 30. Accordingly, the heating cycle of the air conditioner using the first and second indoor heat exchangers 411 and 421 may be completed.

The high-temperature, high-pressure refrigerant discharged from the compressor 10, 20 may flow into the first connection pipe 60 via the oil separator 11, 21 and the first switching valve 51, and the refrigerant in the first connection pipe 60 may be condensed while passing through the outdoor heat exchanger 61, 71.

The condensed refrigerant may flow into the liquid refrigerant connection pipe 491 via the outdoor expansion valve 63, 73, the supercooler 81, the liquid pipe 93, and the liquid pipe 93*b*. The refrigerant in the liquid refrigerant connection pipe 491 may be expanded while passing through the first and second indoor expansion valves 413 and 423, and may be evaporated while passing through the first and second indoor heat exchangers 411 and 421. Accordingly, the indoor space in which the first and second indoor heat exchangers 411 and 421 are installed may be cooled. The first and second indoor expansion valves 413 and 423 may control the degree of superheat. The degree of superheat is a difference between the temperature of the refrigerant suctioned into the compressor 10, 20 (or the temperature of the refrigerant at the outlet side of the first and second indoor heat exchangers 411 and 421) and the saturation temperature corresponding to the evaporation pressure of the first and second indoor heat exchangers 411 and 421 (or the temperature of the refrigerant at the inlet side of the first and second indoor heat exchangers 411 and 421).

The evaporated refrigerant may flow into the low pressure pipe 92 through the gaseous refrigerant connection pipe 310, the gas pipe 91*b*, 91, and the second switching valve 52. The refrigerant in the low pressure pipe 92 may be returned to the compressor 10, 20 via the accumulator 30. Accordingly, the cooling cycle of the air conditioner using the first and second indoor heat exchangers 411 and 421 may be completed.

Figure 7:
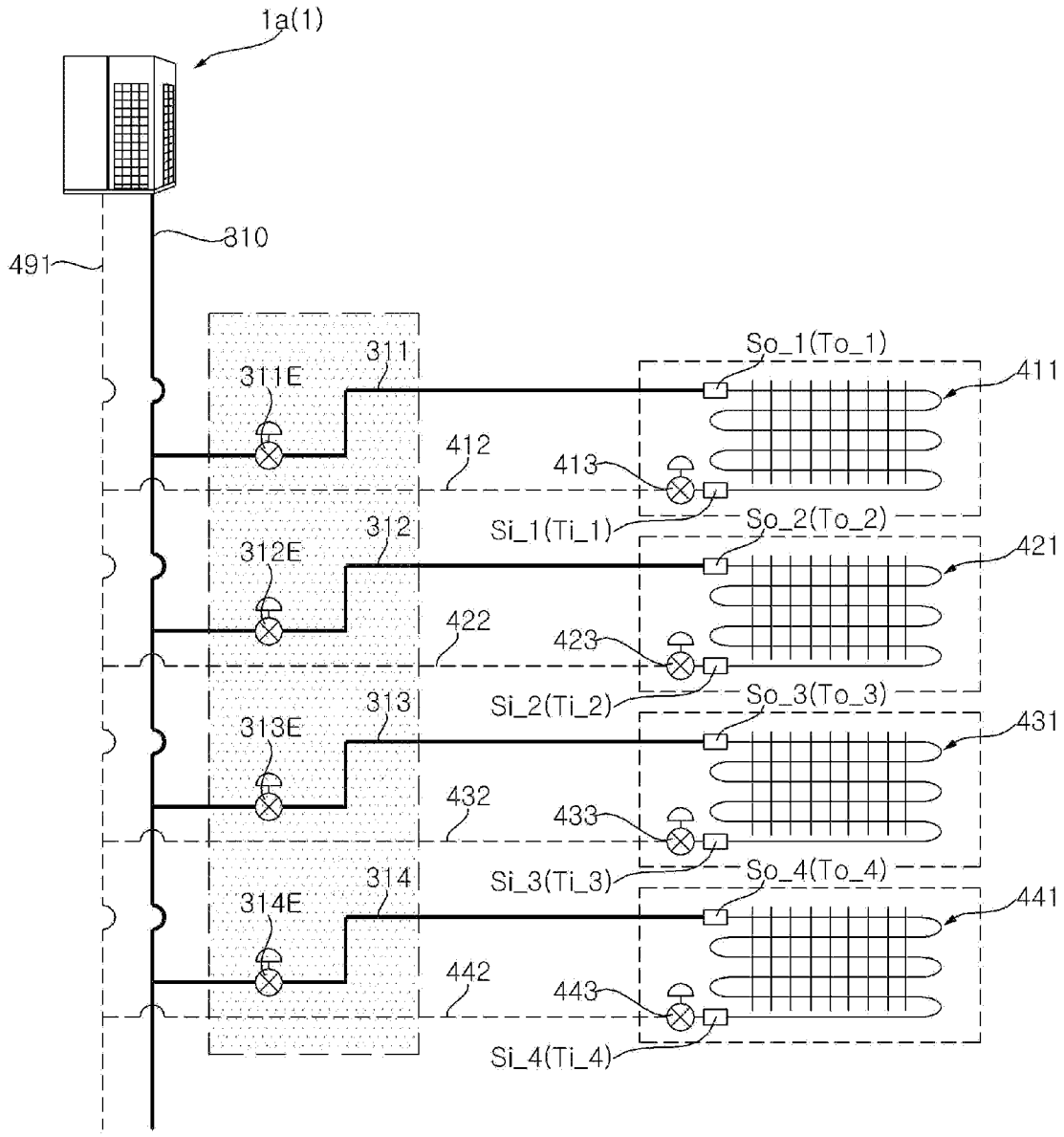

Referring to FIGS. 6 and 7, the plurality of indoor heat exchangers 411, 421, 431, and 441 may serve as an evaporator and may have the same or different evaporation pressures. The plurality of low pressure valves 311E, 312E, 313E, and 314E and the plurality of indoor expansion valves 413, 423, 433, and 443 may be opened. The low pressure valves 311E, 312E, 313E, and 314E may be referred to as variable valves 311E, 312E, 313E, and 314E.

The high-temperature, high-pressure refrigerant discharged from the compressor 10, 20 may flow into the first connection pipe 60 via the oil separator 11, 21 and the first switching valve 51, and the refrigerant of the first connection pipe 60 may be condensed while passing through the outdoor heat exchanger 61, 71. The condensed refrigerant may flow into the liquid refrigerant connection pipe 491 via the outdoor expansion valve 63, 73, the supercooler 81, the liquid pipe 93, and the liquid pipe 93*b*.

The refrigerant of the liquid refrigerant connection pipe 491 may pass through the plurality of connection pipes 412, 422, 432, and 442, be expanded by the plurality of indoor expansion valves 413, 423, 433, and 443, and be evaporated while passing through the plurality of indoor heat exchangers 411, 421, 431, and 441. Thus, the indoor space in which the plurality of indoor heat exchangers 411, 421, 431, and 441 are installed may be cooled. The evaporated refrigerant may be provided to the gaseous refrigerant connection pipe 310 via the plurality of connection pipes 311, 312, 313, and 314 and the plurality of low pressure valves 311E, 312E, 313E, and 314E.

The refrigerant of the gaseous refrigerant connection pipe 310 may flow into the low pressure pipe 92 through the gas pipe 91*b*, 91 and the second switching valve 52. The refrigerant in the low pressure pipe 92 may be returned to the compressor 10, 20 via the accumulator 30. Accordingly, the cooling cycle of the air conditioner using the plurality of indoor heat exchangers 411, 421, 431, and 441 may be completed.

In this case, each of the plurality of indoor expansion valves 413, 423, 433, and 443 may control the degree of superheat of each of the plurality of indoor heat exchangers 411, 421, 431, and 441. The degree of superheat is a difference between the temperature of the refrigerant suctioned into the compressor 10, 20 (or the temperature of the refrigerant at the outlet side of each indoor heat exchanger) and the saturation temperature corresponding to the evaporation pressure of each indoor heat exchanger (or the temperature of the refrigerant at the inlet side of each indoor heat exchanger). For example, the temperature (To_1, To_2, To_3, To_4) of the refrigerant at the outlet side of each of the plurality of indoor heat exchangers 411, 421, 431, and 441 may be measured by each of the plurality of temperature sensors So_1, So_2, So_3, and So_4.

When the compressor 10, 20 of the outdoor unit 1*a* operates at a specific operating frequency, the pressure of the refrigerant suctioned into the compressor 10, 20 may be constant. In this case, the evaporation pressure of each of the plurality of indoor heat exchangers 411, 421, 431, and 441 may be adjusted by adjusting the opening degree of each of the plurality of low pressure valves 311E, 312E, 313E, and 314E. In addition, the refrigerant that passes through each of the plurality of indoor expansion valves 413, 423, 433, and 443, and flows into the inlet of each of the plurality of indoor heat exchangers 411, 421, 431, and 441 has a two-phase state. Thus, it may be said that the temperature of the refrigerant at the inlet side of each of the plurality of indoor heat exchangers 411, 421, 431, and 441 may be adjusted by adjusting the opening degree of each of the plurality of low pressure valves 311E, 312E, 313E, and 314E. This may be expressed as in Equation 2 below.

$$L1=f(Ti_1),L2=f(Ti_2),L3=f(Ti_3),L4=f(Ti_4) \quad \text{Equation 2:}$$

Here, L1 is the opening degree of the first low pressure valve 311E, and Ti_1 is the temperature of the refrigerant at the inlet side of the first indoor heat exchanger 411, which may be measured by a first temperature sensor Si_1. L2 is the opening degree of the second low pressure valve 312E, and Ti_2 is the temperature of the refrigerant at the inlet side of the second indoor heat exchanger 421, which may be measured by a second temperature sensor Si_2. L3 is the opening degree of the third low pressure valve 313E, and Ti_3 is the temperature of the refrigerant at the inlet side of the third indoor heat exchanger 431, which may be measured by a third temperature sensor Si_3. L4 is the opening degree of the fourth low pressure valve 314E, and Ti_4 is the temperature of the refrigerant at the inlet side of the fourth indoor heat exchanger 441, which may be measured by a fourth temperature sensor Si_4. Alternatively, more specifically, the opening degree of the low pressure valve described above and later may be adjusted based on the pressure of the refrigerant at the inlet side of the indoor heat exchanger measured by a pressure sensor.

In this case, if the pressure drop of the refrigerant in the refrigerant pipe connecting the indoor heat exchanger and the compressor is excluded from being considered, the evaporation pressure of the indoor heat exchanger 411, 421, 431, 441 connected to the fully opened low pressure valves 311E, 312E, 313E, 314E may be the same as the pressure of the refrigerant at the inlet side of the compressor 10, 20. In addition, as the opening degree of the low pressure valve 311E, 312E, 313E, 314E decreases, the evaporation pressure of the indoor heat exchanger 411, 421, 431, 441 connected thereto increases and may be greater than the pressure (fixed value) of the refrigerant at the inlet side of the compressor 10, 20.

Accordingly, the controller C of the air conditioner adjusts the opening degree of each of the plurality of low pressure valves 311E, 312E, 313E, and 314E, thereby adjusting the temperature (or pressure) of the refrigerant at the inlet side of each of the plurality of indoor heat exchangers 411, 421, 431, and 441. In other words, in order to adjust the temperature (or pressure) of the refrigerant at the inlet side of each of the plurality of indoor heat exchangers 411, 421, 431, and 441 to the target temperature (or target pressure), the opening degree of each of the plurality of low pressure valves 311E, 312E, 313E, and 314E may be adjusted. As a result, the temperature (blowdown temperature) of indoor air supplied to the cooling space through each of the plurality of indoor heat exchangers 411, 421, 431, and 441 may be adjusted for each indoor heat exchanger.

For example, the opening degree of the second low pressure valve 312E may be smaller than the opening degree of the first low pressure valve 311E, and larger than the opening degree of the third low pressure valve 313E. The opening degree of the fourth low pressure valve 314E may be smaller than the opening degree of the third low pressure valve 313E. Based on a case in which the indoor heat exchangers have the same superheat, the blowdown temperature may be higher in the order of the fourth indoor heat exchanger 441, the third indoor heat exchanger 431, the second indoor heat exchanger 421, and the first indoor heat exchanger 411.

Figure 8:
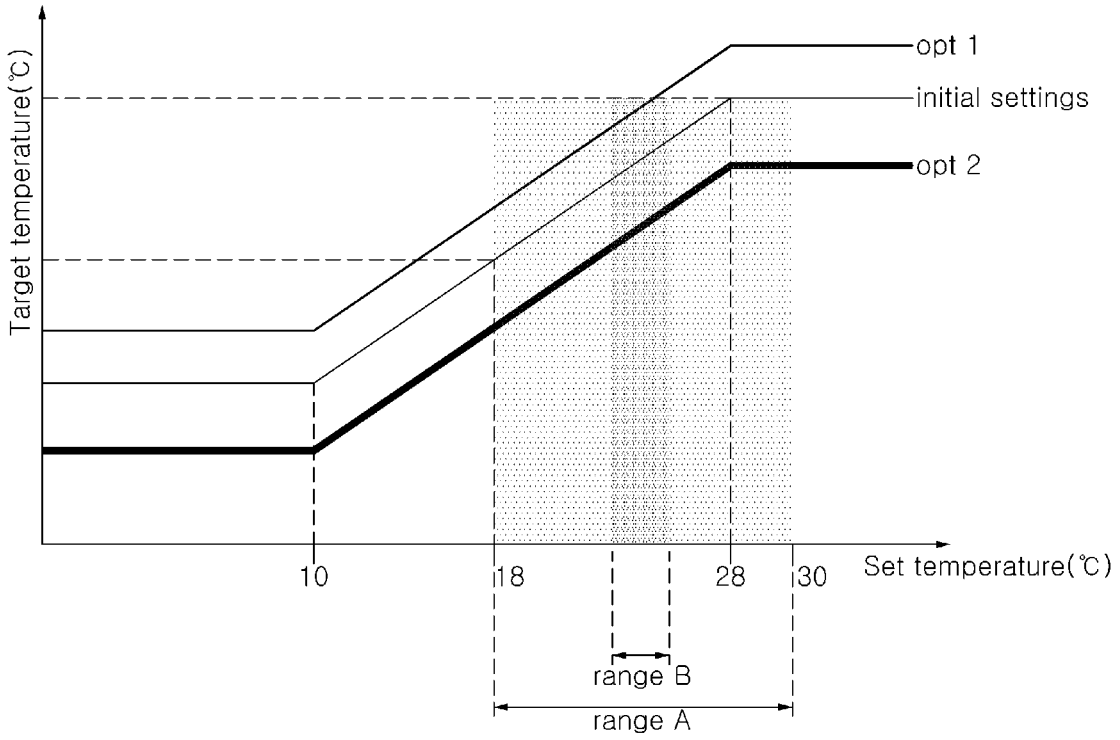
FIGS. 8 and 9 are graphs for explaining a method for determining a target temperature of refrigerant in an inlet side of the indoor heat exchanger.

Referring to FIG. 8, the following method may be used to determine the target temperature of the refrigerant at the inlet side of the indoor heat exchanger. The temperature range (range A) of the indoor space that may be selected by a user may be 18 to 30° C., and the temperature range (range B) of the indoor space that a user mainly selects may be 25 to 27° C. For example, if a user selects a temperature within the temperature range (range B), it may be estimated that the user wishes to provide air at 14 to 15° C. to the indoor space, and the target temperature of the refrigerant at the inlet side of the indoor heat exchanger may be controlled at 1213° C. and the degree of superheat may be controlled at 1-2° C.

In initial settings, the target temperature of the refrigerant at the inlet side of the specific indoor heat exchanger may decrease as a set temperature of a specific indoor space selected by a user decreases. That is, as the set temperature of the specific indoor space selected by a user decreases, the opening degree of the low pressure valves (121E, 122E, 123E, 124E, see FIG. 5; 311E, 312E, 313E, 314E, see FIG. 7) connected to the specific indoor heat exchanger increases.

In a first user settings (opt 1), the target temperature of the refrigerant at the inlet side of a specific indoor heat exchanger may decrease as a set temperature of a specific indoor space selected by a user decreases. That is, as a set temperature of a specific indoor space selected by a user decreases, the opening degree of the low pressure valves (121E, 122E, 123E, 124E, see FIG. 5; 311E, 312E, 313E, 314E, see FIG. 7) connected to the specific indoor heat exchanger increases. However, in a set temperature-target temperature graph, the first user settings (opt 1) may be offset toward the (+) side of a target temperature axis than the initial settings. That is, for the same set temperature, the target temperature according to the first user settings may be higher than the target temperature according to the initial settings. The first user settings may be referred to as a low speed cooling setting.

In a second user settings (opt 2), the target temperature of the refrigerant at the inlet side of a specific indoor heat exchanger may decrease as a set temperature of a specific indoor space selected by a user decreases. That is, as a set temperature of a specific indoor space selected by a user decreases, the opening degree of the low pressure valves (121E, 122E, 123E, 124E, see FIG. 5; 311E, 312E, 313E, 314E, see FIG. 7) connected to the specific indoor heat exchanger increases. However, in a set temperature-target temperature graph, the second user settings (opt 2) may be offset toward the (−) side of a target temperature axis than the initial settings. That is, for the same set temperature, the target temperature according to the second user settings may be lower than the target temperature according to the initial settings. The second user settings may be referred to as a high speed cooling setting.

Figure 9:
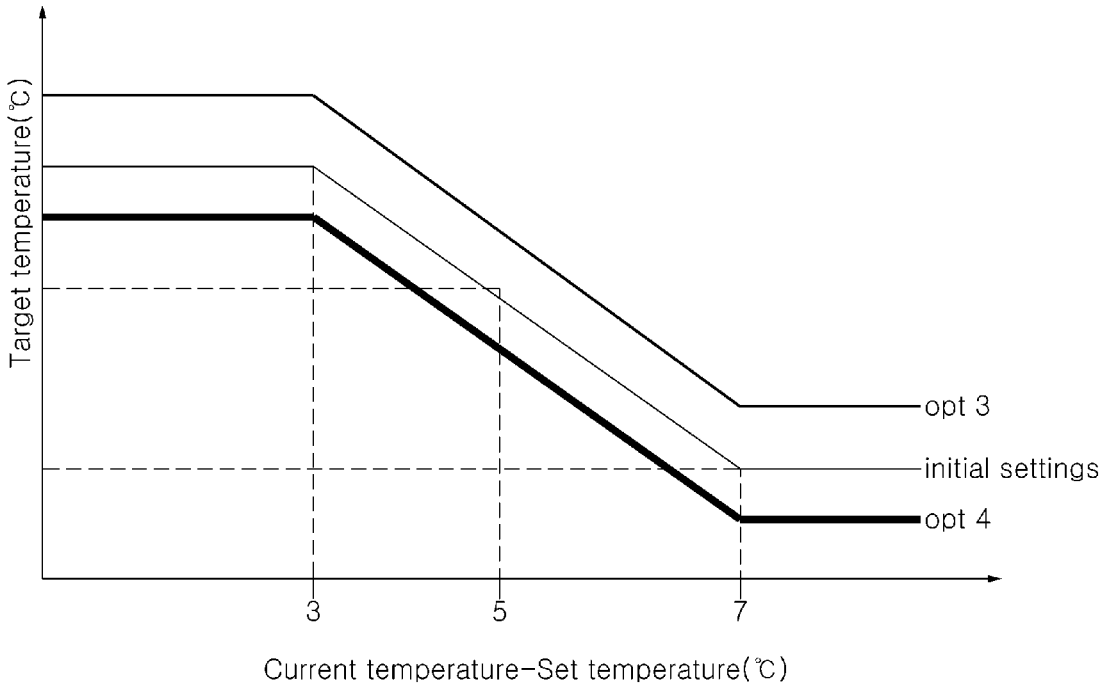

Referring to FIG. 9, the following method may be used to determine the target temperature of the refrigerant at the inlet side of the indoor heat exchanger.

In initial settings, as a difference between a current temperature of a specific indoor space of interest to a user and a set temperature of the specific indoor space selected by the user (hereinafter referred to as temperature difference) increases, a target temperature of the refrigerant at the inlet side of the specific indoor heat exchanger may be lowered. That is, as the temperature difference increases, the opening degree of the low pressure valve (121E, 122E, 123E, 124E, see FIG. 5; 311E, 312E, 313E, 314E, see FIG. 7) connected to the specific indoor heat exchanger may increase.

In a third user settings (opt 3), the target temperature of the refrigerant at the inlet side of a specific indoor heat exchanger may decrease as the temperature difference increases. That is, as the temperature difference increases, the opening degree of the low pressure valve (121E, 122E, 123E, 124E, see FIG. 5; 311E, 312E, 313E, 314E, see FIG. 7) connected to the specific indoor heat exchanger may increase. However, in the temperature difference-target temperature graph, the third user settings (opt 3) may be offset toward the (+) side of a target temperature axis than the initial settings. That is, with respect to the same temperature difference, the target temperature according to the third user settings may be higher than the target temperature according to the initial settings. The third user settings may be referred to as a low speed cooling settings.

In a fourth user settings (opt 4), the target temperature of the refrigerant at the inlet side of a specific indoor heat exchanger may decrease as the temperature difference increases. That is, as the temperature difference increases, the opening degree of the low pressure valve (121E, 122E, 123E, 124E, see FIG. 5; 311E, 312E, 313E, 314E, see FIG. 7) connected to the specific indoor heat exchanger may increase. However, in the temperature difference-target temperature graph, the fourth user settings (opt 4) may be offset toward the (+) side of a target temperature axis than the initial settings. That is, with respect to the same temperature difference, the target temperature according to the fourth user settings may be lower than the target temperature according to the initial settings. The fourth user settings may be referred to as a high speed cooling settings.

Referring to FIG. 10, a look up table may be used to adjust the opening of the low pressure valve in order to adjust the temperature of the refrigerant at the inlet side of the indoor heat exchanger to a target temperature. An error, which is a variable on a vertical axis of the lookup table of FIG. 10, is a difference between the current temperature (Ti_present) of the refrigerant at the inlet side of the indoor heat exchanger and the target temperature (Ti_target). An error slope, which is a variable on a horizontal axis of the lookup table of FIG. 10, is a difference between the current temperature (Ti_present) of the refrigerant at the inlet side of the indoor heat exchanger for a certain time period (at) and the previous temperature (Ti_past).

$$\text{Error}=Ti_\text{present}-Ti_\text{target};\text{Error slope}=(Ti_\text{present}-Ti_\text{past})/\Delta t \qquad \text{Equation 3:}$$

The numbers in the look-up table of FIG. 10 indicates that the opening degree of the low pressure valve (121E, 122E, 123E, 124E, see FIG. 5; 311E, 312E, 313E, 314E, see FIG. 7) is maintained intactly, or indicates the degree to which the opening degree is increased or decreased. The number 0 means that the opening degree of the low pressure valve (121E, 122E, 123E, 124E, see FIG. 5; 311E, 312E, 313E, 314E, see FIG. 7) is maintained intactly. For example, the number 1 means that the opening degree of the low pressure valve (121E, 122E, 123E, 124E, see FIG. 5; 311E, 312E, 313E, 314E, see FIG. 7) is increased by 1% from the current state. For example, the number −3 means that the opening degree of the low pressure valve (121E, 122E, 123E, 124E, see FIG. 5; 311E, 312E, 313E, 314E, see FIG. 7) is decreased by −3% from the current state. For example, the weight of the error for the change in the opening degree of the low pressure valve (121E, 122E, 123E, 124E, see FIG. 5; 311E, 312E, 313E, 314E, see FIG. 7) may be greater than the weight of the error slope.

If the error is '0' but the error slope is a positive number greater than or equal to a certain value, the controller C of the air conditioner may lower the temperature of the refrigerant at the inlet side of a specific indoor heat exchanger by increasing the opening degree of a specific low pressure valve connected to the specific indoor heat exchanger. If the error is '0' but the error slope is a negative number less than a certain value, the controller C of the air conditioner reduces the opening degree of a specific low pressure valve connected to a specific indoor heat exchanger to increase the temperature of the refrigerant at the inlet side of the specific indoor heat exchanger.

If the error slope is '0' but the error is a positive number, the controller C of the air conditioner may increase the opening degree of a specific low pressure valve connected to a specific indoor heat exchanger to lower the temperature of the refrigerant at the inlet side of the specific indoor heat exchanger. If the error slope is '0' but the error is negative, the controller C of the air conditioner may decrease the opening degree of a specific low pressure valve connected to a specific indoor heat exchanger to increase the temperature of the refrigerant at the inlet side of the specific indoor heat exchanger.

Figure 11:
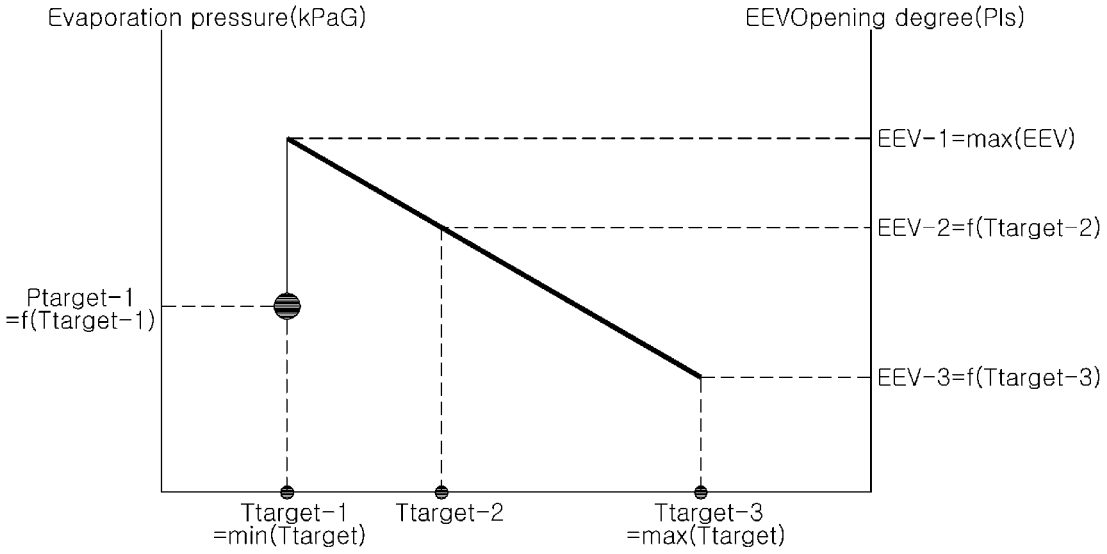
FIG. 11 is a graph for explaining a method for adjusting the opening degrees of variable valves connected to indoor heat exchangers having different target temperatures.

Referring to FIG. 11, the low pressure valve connected to a specific indoor heat exchanger in which the lowest target temperature (min(Ttarget)) is set among the target temperatures of the refrigerant at the inlet side of the plurality of indoor heat exchangers may be fully opened, and the operating frequency Hz of the compressor 10, 20 may be controlled to adjust the temperature of the refrigerant at the inlet side of the specific indoor heat exchanger to the lowest target temperature (min(Ttarget)).

For example, the target temperature (Ttarget-1) of the refrigerant at the inlet side of the first indoor heat exchanger (211, see FIG. 5; 411, see FIG. 7) may be the lowest target temperature (min(Ttarget)). The target temperature (Ttarget-2) of the refrigerant at the inlet side of the second indoor heat exchanger (221, see FIG. 5; 421, see FIG. 7) may be greater than the target temperature (Ttarget-1). The target temperature (Ttarget-3) of the refrigerant at the inlet side of the third indoor heat exchanger (231, see FIG. 5; 431, see FIG. 7) may be the highest target temperature (max(Ttarget)).

The opening degree of the first low pressure valve (EEV-1) (121E, see FIG. 5; 311E, see FIG. 7) connected to the first indoor heat exchanger (211, see FIG. 5; 411, see FIG. 7) may be set to the maximum. The target temperature (Ttarget-1) or a corresponding target pressure (Ptarget-1) may be adjusted by controlling the operating frequency Hz of the compressor 10, 20.

The opening degree of the second low pressure valve (EEV-2) (122E, see FIG. 5; 312E, see FIG. 7) connected to the second indoor heat exchanger (221, see FIG. 5; 421, see FIG. 7) may be adjusted to meet the target temperature (Ttarget-2). Further, the opening degree of the third low pressure valve (EEV-3) (123E, see FIG. 5; 313E, see FIG. 7) connected to the third indoor heat exchanger (231, see FIG. 5; 431, see FIG. 7) may be adjusted to meet the target temperature (Ttarget-3). Accordingly, compared to a case where all the low pressure valves are partially closed, unnecessary pressure loss and efficiency reduction may be prevented.

Figure 12:
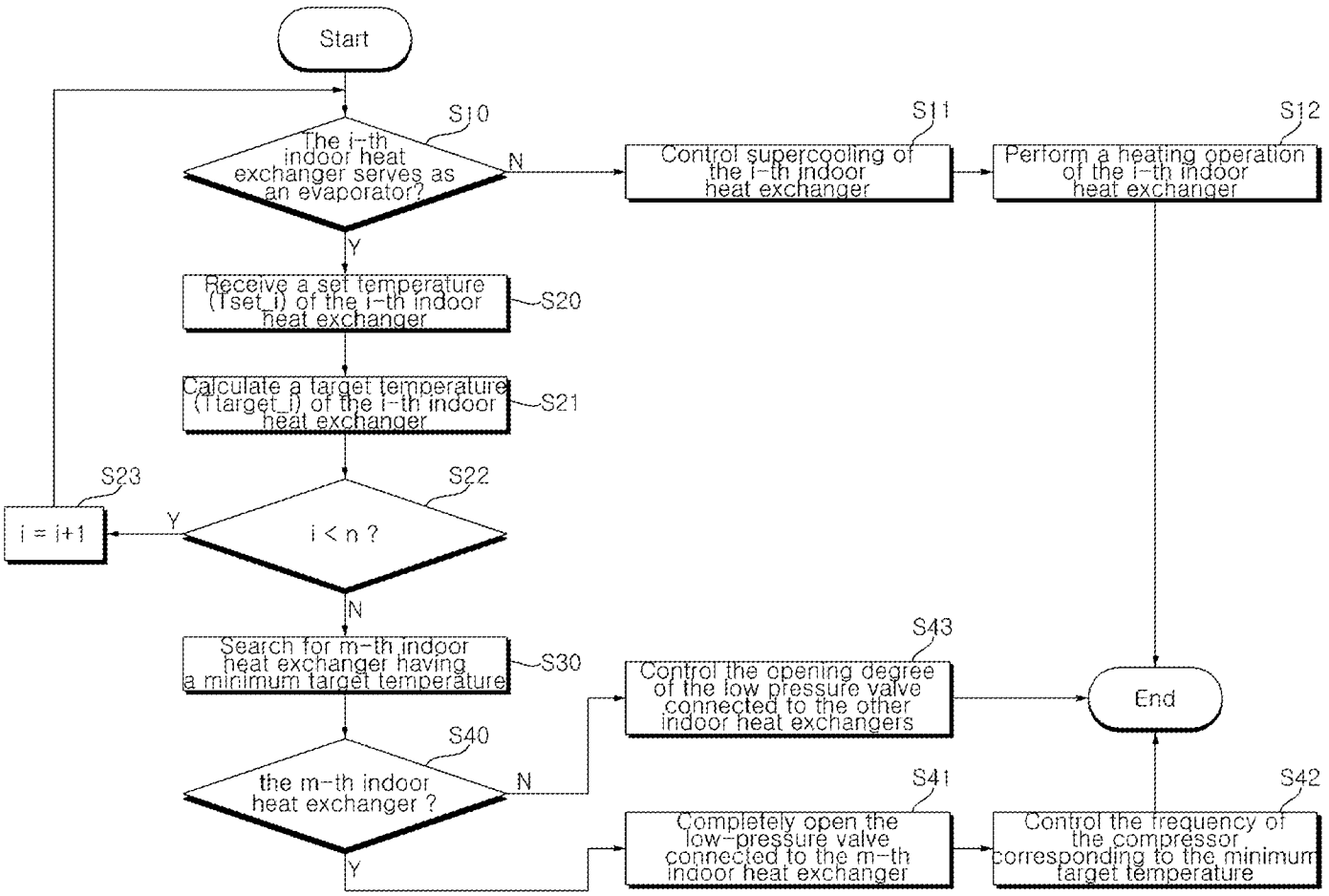
FIG. 12 is a flowchart of a method for controlling an air conditioner according to an embodiment.

Referring to FIGS. 5 and 12, the controller C of the air conditioner may be electrically connected to components of the air conditioner to control their operations.

When the i-th indoor heat exchanger, among the plurality of indoor heat exchangers 211, 221, 231, and 241, serves as an evaporator (S10: Yes), the controller C may receive a set temperature (Tset_i, for example, a temperature selected (input) by a user) of the i-th indoor heat exchanger (S20), and calculate a target temperature (Ttarget_i, see FIGS. 8 and 9) of the refrigerant at the inlet side of the i-th indoor heat exchanger (S21). When the i-th indoor heat exchanger, among the plurality of indoor heat exchangers 211, 221, 231, and 241, does not serve as an evaporator (S10: No) and serves as a condenser, the controller C may perform a heating operation while controlling supercooling of the i-th indoor heat exchanger (S11, S12). Here, i starts from 1 and may terminate at n, which is the total number of indoor heat exchangers (S22, S23). That is, the above described steps (S10, S20, S21, S11, S12) may be sequentially performed for all indoor heat exchangers (S22, S23).

The controller C may search for m-th indoor heat exchanger having a minimum target temperature (min(Ttarget)) among indoor heat exchangers serving as an evaporator (S30). For example, some of indoor heat exchangers serving as an evaporator may have a minimum target temperature (min(Ttarget)). In this case, m may be a number(s) corresponding to the sequence number(s) of some of the indoor heat exchangers serving as an evaporator. For another example, all indoor heat exchangers serving as an evaporator may have a minimum target temperature (min(Ttarget)). In this case, m may be numbers corresponding to the sequence numbers of all indoor heat exchangers serving as an evaporator.

With respect to the m-th indoor heat exchanger (S40: Yes), the controller C may completely open the low pressure valve (121E, 122E, 123E, 124E, see FIG. 5) connected to the m-th indoor heat exchanger (S41), and may control the operating frequency Hz of the compressor 10, 20 so as to correspond to the minimum target temperature (min(Ttarget)) (S42). With respect to other indoor heat exchanger (S40: No), the controller C may control the opening degree of the low pressure valve 121E, 122E, 123E, 124E (see FIG. 5) connected to the other indoor heat exchanger to match the target temperature (Ttarget) of the refrigerant at the inlet side of the other indoor heat exchanger (S43). Accordingly, if necessary, the blowdown temperature, which is the temperature of the air supplied to the cooling space, may be adjusted differently for each indoor heat exchanger.

Figure 13:
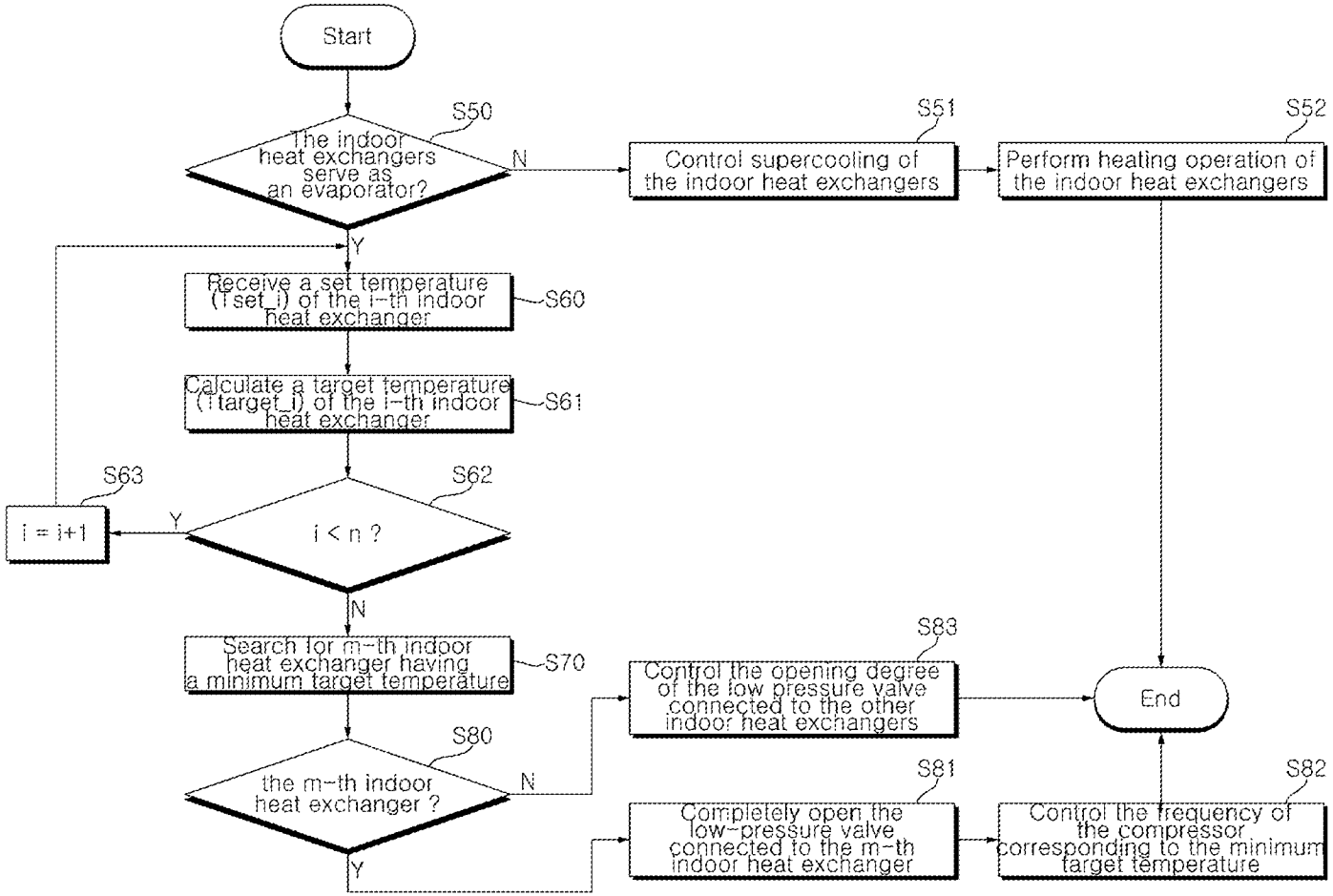
FIG. 13 is a flowchart of a method for controlling an air conditioner according to another embodiment.

Referring to FIGS. 7 and 13, the controller C of the air conditioner may be electrically connected to components of the air conditioner to control their operations.

When the plurality of indoor heat exchangers 411, 421, 431, and 441 serve as an evaporator (S50: Yes), the controller C may receive a set temperature (Tset_i) (for example, a temperature selected (input) by a user) of the i-th indoor heat exchanger (S60), and may calculate the target temperature (Ttarget_i, see FIGS. 8 and 9) of the refrigerant at the inlet side of the i-th indoor heat exchanger (S61). When the i-th indoor heat exchanger, among the plurality of indoor heat exchangers 211, 221, 231, and 241, does not serve as an evaporator (S50: No) and serves as a condenser, the controller C may perform a heating operation while controlling supercooling of indoor heat exchanger (S51, S52). Here, i starts from 1 and may terminate at n, which is the total number of indoor heat exchangers (S62, S63). That is, the above described steps (S60, S61) may be sequentially performed for all indoor heat exchangers (S62, S63).

The controller C may search for m-th indoor heat exchanger having a minimum target temperature (min(Ttarget)) among indoor heat exchangers serving as an evaporator (S70). For example, some of indoor heat exchangers serving as an evaporator may have a minimum target temperature (min(Ttarget)). In this case, m may be a number(s) corresponding to the sequence number(s) of some of the indoor heat exchangers serving as an evaporator. For another example, all indoor heat exchangers serving as an evaporator may have a minimum target temperature (min(Ttarget)). In this case, m may be number(s) corresponding to the sequence numbers of all indoor heat exchangers serving as an evaporator.

With respect to the m-th indoor heat exchanger (S80: Yes), the controller C may completely open the low pressure valve (311E, 312E, 313E, 314E, see FIG. 7) connected to the m-th indoor heat exchanger (S81), and may control the operating frequency Hz of the compressor 10, 20 so as to correspond to the minimum target temperature (min(Ttarget)) (S82). With respect to other indoor heat exchanger (S80: No), the controller C may control the opening degree of the low pressure valve 311E, 312E, 313E, 314E (see FIG. 7) connected to the other indoor heat exchanger to match the target temperature (Ttarget) of the refrigerant at the inlet side of the other indoor heat exchanger (S83). Accordingly, if necessary, the blowdown temperature, which is the temperature of the air supplied to the cooling space, may be adjusted differently for each indoor heat exchanger.

Advantages of the air conditioner according to embodiments disclosed herein include at least the following.

According to at least one of embodiments disclosed herein, it is possible to provide an air conditioner capable of setting different evaporation pressures of a plurality of indoor heat exchangers functioning as an evaporator, thereby differently setting a blowdown temperature for each indoor space.

According to at least one of embodiments disclosed herein, it is possible to provide a method for setting a target temperature of a refrigerant in an inlet side of an indoor heat exchanger.

According to at least one of embodiments disclosed herein, it is possible to provide a method for adjusting the opening degree of a variable valve to adjust the temperature of the refrigerant in an inlet side of an indoor heat exchanger to a target temperature.

According to at least one of embodiments disclosed herein, it is possible to provide an air conditioner capable of preventing unnecessary pressure drop and efficiency reduction.

Embodiments disclosed herein solve at least the above and other problems.

Embodiments disclosed herein provide an air conditioner capable of setting different evaporation pressures of a plurality of indoor heat exchangers functioning as an evaporator, thereby differently setting a blowdown temperature for each indoor space.

Embodiments disclosed herein provide a method for setting a target temperature of a refrigerant in an inlet side of an indoor heat exchanger.

Embodiments disclosed herein provide a method for adjusting the opening degree of a variable valve to adjust the temperature of the refrigerant in an inlet side of an indoor heat exchanger to a target temperature.

Embodiments disclosed herein provide an air conditioner capable of preventing unnecessary pressure drop and efficiency reduction.

Embodiments disclosed herein provide an air conditioner that may include a compressor that compresses a refrigerant; an outdoor heat exchanger through which the refrigerant discharged from the compressor flows; a plurality of expansion valves that expands the refrigerant passed through the outdoor heat exchanger; a plurality of indoor heat exchangers through which the refrigerant passed through the plurality of expansion valves flows; a plurality of connection pipes that connect the plurality of indoor heat exchangers and the compressor; and a plurality of variable valves installed in the plurality of connection pipes. An opening degree of each of the plurality of variable valves may be adjustable.

The variable valve may be an electronic expansion valve (EEV). A pressure of refrigerant at an inlet side of the indoor heat exchanger may increase as the opening degree of the variable valve decreases.

The opening degree of the variable valve may increase as a user's set temperature for the indoor heat exchanger decreases. The opening degree of the variable valve may increase as a difference between a current temperature of a room where the indoor heat exchanger is located and the user's set temperature for the indoor heat exchanger increases.

The opening degree of the variable valve may be adjusted based on an error which is a difference between a current temperature of refrigerant at an inlet side of the indoor heat exchanger and a target temperature, and an error slope which is a temperature change of the refrigerant at the inlet side of the indoor heat exchanger for a certain period of time. The opening degree of the variable valve may be increased than current one when the error is '0' and the error slope is positive. The opening degree of the variable valve may be decreased than current one when the error is '0' and the error slope is negative. The opening degree of the variable valve may be increased than current one when the error slope is '0' and the error is positive. The opening degree of the variable valve may be decreased than current one when the error slope is '0' and the error is negative.

A weight of the error may be greater than a weight of the error slope with respect to a change in the opening degree of the variable valve.

One of the plurality of variable valves may be connected to a specific indoor heat exchanger in which the lowest target temperature is set among target temperatures of refrigerant at an inlet side of the plurality of indoor heat exchangers, and may be fully opened. An operating frequency of the compressor may be adjustable to match a temperature of refrigerant at an inlet side of the specific indoor heat exchanger to the lowest target temperature.

An opening degree of the expansion valve may be adjustable to adjust a superheat degree which is a difference between a temperature of refrigerant at an outlet side of the indoor heat exchanger and a temperature of refrigerant at an inlet side.

The air conditioner may further include a temperature sensor that measures a temperature of refrigerant at an outlet side of the indoor heat exchanger and a temperature of refrigerant at an inlet side. Some of the plurality of indoor heat exchangers may be maintained as an evaporator through which the refrigerant passed through the expansion valve flows, and the rest of the plurality of indoor heat exchangers may be switchable into a condenser through which the refrigerant discharged from the compressor flows.

The plurality of indoor heat exchangers may be switchable from an evaporator through which the refrigerant passed through the expansion valve flows into a condenser through which the refrigerant discharged from the compressor flows.

Certain embodiments or other embodiments described above are not mutually exclusive or distinct from each other. Any or all elements of the embodiments of the invention described above may be combined or combined with each other in configuration or function.

For example, a configuration "A" described in one embodiment of the invention and the drawings and a configuration "B" described in another embodiment of the invention and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a controller;

a compressor that compresses a refrigerant;

an outdoor heat exchanger through which the refrigerant discharged from the compressor flows;

a plurality of expansion valves that expands the refrigerant passed through the outdoor heat exchanger;

a plurality of indoor heat exchangers through which the refrigerant passed through the plurality of expansion valves flows;

a plurality of connection pipes that connects the plurality of indoor heat exchangers and the compressor; and a plurality of variable valves installed in the plurality of connection pipes, wherein an opening degree of each of the plurality of variable valves is adjustable via the controller, and wherein the opening degree of the variable valve is adjusted by the controller based on an error, which is a difference between a current temperature of refrigerant at an inlet side of the respective indoor heat exchanger and a target temperature, and an error slope, which is a temperature change of the refrigerant at the inlet side of the respective indoor heat exchanger for a predetermined period of time.

2. The air conditioner of claim 1, wherein the variable valves are electronic expansion valves (EEVs).

3. The air conditioner of claim 1, wherein a pressure of refrigerant at an inlet side of each indoor heat exchanger of the plurality of indoor heat exchangers increases as the opening degree of the respective variable valve is decreased by the controller.

4. The air conditioner of claim 1, wherein the opening degree of the variable valve is increased by the controller as a user's set temperature for the respective indoor heat exchanger is decreased.

5. The air conditioner of claim 1, wherein the opening degree of the variable valve is increased by the controller as a difference between a current temperature of a room in which the respective indoor heat exchanger is located and a user's set temperature for the respective indoor heat exchanger increases.

6. The air conditioner of claim 1, wherein the opening degree of the variable valve is increased by the controller when the error is '0' and the error slope is positive, and is decreased when the error is '0' and the error slope is negative.

7. The air conditioner of claim 1, wherein the opening degree of the variable valve is increased by the controller when the error slope is '0' and the error is positive, and is decreased when the error slope is '0' and the error is negative.

8. The air conditioner of claim 1, wherein a weight of the error is greater than a weight of the error slope with respect to a change in the opening degree of the variable valve.

9. The air conditioner of claim 1, wherein one of the plurality of variable valves is connected to a specific indoor heat exchanger of the plurality of indoor heat exchangers in which a lowest target temperature is set among target temperatures of refrigerant at an inlet side of the plurality of indoor heat exchangers, and is fully opened by the controller.

10. The air conditioner of claim 9, wherein the controller is configured to adjust an operating frequency of the compressor to match a temperature of refrigerant at an inlet side of the specific indoor heat exchanger to the lowest target temperature.

11. The air conditioner of claim 1, wherein an opening degree of each expansion valve is adjustable by the controller to adjust a superheat degree, which is a difference between a temperature of refrigerant at an outlet side of the respective indoor heat exchanger and a temperature of refrigerant at an inlet side.

12. The air conditioner of claim 11, further comprising a temperature sensor that measures the temperature of refrigerant at the outlet side of the respective indoor heat exchanger and the temperature of refrigerant at the inlet side.

13. The air conditioner of claim 1, wherein some of the plurality of indoor heat exchangers is maintained as an evaporator through which the refrigerant passed through the expansion valve flows, and the rest of the plurality of indoor heat exchangers is switchable into a condenser through which the refrigerant discharged from the compressor flows.

14. The air conditioner of claim 1, wherein the plurality of indoor heat exchangers is switchable from an evaporator through which the refrigerant passed through the expansion valve flows into a condenser through which the refrigerant discharged from the compressor flows.

15. An air conditioner, comprising:

a controller;

at least one compressor that compresses a refrigerant;

at least one outdoor heat exchanger through which the refrigerant discharged from the at least one compressor flows;

a plurality of expansion valves that expands the refrigerant passed through the at least one outdoor heat exchanger;

a plurality of indoor heat exchangers through which the refrigerant passed through the plurality of expansion valves flows;

a plurality of connection pipes that connects the plurality of indoor heat exchangers and the at least one compressor; and a plurality of variable valves installed in the plurality of connection pipes, wherein an opening degree of each of the plurality of variable valves is adjustable via the controller, and wherein the opening degree of the variable valve is adjusted by the controller based on an error, which is a difference between a current temperature of refrigerant at an inlet side of the respective indoor heat exchanger and a target temperature, and an error slope, which is a temperature change of the refrigerant at the inlet side of the respective indoor heat exchanger for a predetermined period of time.

16. The air conditioner of claim 15, wherein the opening degree of the variable valve is increased by the controller at least one when the error is '0' and the error slope is positive, and is decreased when the error is '0' and the error slope is negative.

17. The air conditioner of claim 15, wherein the opening degree of the variable valve is increased by the controller at least one when the error slope is '0' and the error is positive, and is decreased when the error slope is '0' and the error is negative.

18. The air conditioner of claim 15, wherein a weight of the error is greater than a weight of the error slope with respect to a change in the opening degree of the variable valve.

* * * * *